United States Patent [19]

Carleton et al.

[11] 4,264,466

[45] Apr. 28, 1981

[54] MULLS CONTAINING CHAIN STRUCTURE CLAY SUSPENSION AIDS

[75] Inventors: Karen L. Carleton, Needham, Mass.; John P. Rowland, Cincinnati, Ohio

[73] Assignee: The Procter & Gamble Company, Cincinnati, Ohio

[21] Appl. No.: 121,359

[22] Filed: Feb. 14, 1980

[51] Int. Cl.[3] ..... C11D 3/12

[52] U.S. Cl. ..... 252/99; 252/95; 252/104; 252/131; 252/140; 252/154; 252/155; 252/164; 252/174.12; 252/174.21; 252/174.25

[58] Field of Search ..... 252/174.25, 174.12, 252/164, 155, 154, 140, 104, 94, 95, 308, 309, 99, 174.21, 131

[56] References Cited

U.S. PATENT DOCUMENTS

| | | | |
|---|---|---|---|
| 2,594,257 | 4/1952 | Durgin | 252/140 |
| 2,594,258 | 4/1952 | Durgin | 252/140 |
| 2,864,770 | 12/1958 | McCune et al. | 252/532 |
| 3,259,574 | 7/1966 | Morrison et al. | 252/28 |
| 3,472,783 | 10/1969 | Smillie | 252/174.12 |
| 3,549,542 | 12/1970 | Holdersby | 252/524 |
| 3,557,037 | 1/1971 | Collins et al. | 260/29.1 |
| 3,630,929 | 12/1971 | Van Dijk | 252/136 |
| 3,948,790 | 4/1976 | Speakman | 252/120 |
| 3,954,632 | 5/1976 | Gloss | 252/8.8 |
| 4,005,027 | 1/1977 | Hartman | 252/95 |
| 4,018,720 | 4/1977 | Lengyel et al. | 252/534 |
| 4,051,055 | 9/1977 | Trinh et al. | 252/95 |
| 4,069,034 | 1/1978 | Hoover | 71/33 |
| 4,166,039 | 8/1979 | Wise | 252/110 |

FOREIGN PATENT DOCUMENTS

| | | |
|---|---|---|
| 1519605 | 8/1978 | United Kingdom . |
| 2017072 | 10/1979 | United Kingdom . |

OTHER PUBLICATIONS

Grim, *Clay Mineralogy*, 2nd Ed., McGraw-Hill Book Co., New York, 1968, pp. 32, 113-121, 154, 183, 582; FIGS. 6-10 and 6-11.

Velde, *Clay and Clay Minerals in Natural and Synthetic Systems*, Elsevier Scientific Publishing Co., Amsterdam, 1977, p. 11.

*Primary Examiner*—Harris A. Pitlick

*Attorney, Agent, or Firm*—Ronald L. Hemingway; Richard C. Witte

[57] ABSTRACT

Liquid mulls having improved physical stability, consisting of a liquid phase and a dispersed solid phase. The liquid phase contains a major proportion of a nonionic surfactant and optionally contains a minor proportion of a nonaqueous solvent. The dispersed solid phase is a particulate material which is insoluble in the liquid phase of the mull. The inclusion of chain structure type clays in the composition unexpectedly aids the physical stability of the mull, so insoluble particulate materials such as builders having ordinary particle sizes may be incorporated in the compositions. Preferred compositions are substantially anhydrous to allow the optional inclusion of water sensitive detergency adjuvants, such as enzymes or bleaches, in the compositions. The compositions may optionally contain 0% to 25% of a further dispersion aid selected from anionic surfactants, cationic surfactants, zwitterionic surfactants and hydrotropic materials. Such mulls have utility, for example, as detergent compositions.

26 Claims, No Drawings

MULLS CONTAINING CHAIN STRUCTURE CLAY SUSPENSION AIDS

TECHNICAL FIELD

The present invention relates to liquid mulls, that is, liquid compositions containing a substantial amount of insoluble material in dispersed particulate form. The invention relates more particularly to the use of chain structure type clays, in particular the attapulgite, sepiolite, and palygorskite clays, as suspending agents for the above particulate material in a medium containing a minor proportion of water, or preferably no water at all. The present invention relates more narrowly to detergent compositions in the form of liquid mulls, and most narrowly to liquid laundry detergents.

BACKGROUND ART

The prior art contains several references to the use of attapulgite or palygorskite clays to stabilize suspensions. U.S. Pat. No. 4,069,034, issued to Hoover on Jan. 17, 1978, indicates that attapulgite clays or bentonite clays can be used as suspending aids in suspension fertilizers. (Suspension fertilizers are aqueous slurries of a crystalline fertilizer component in a saturated aqueous solution of the component; they are made by partially recrystallizing the crystalline component from a supersaturated aqueous solution.) Hoover is distinguishable from the present invention not only because Hoover requires an aqueous solution, but also because it suggests that the solutions are not completely stable unless another ingredient, humic acid, is added to the composition.

Two of the prior art references relate to the use of several clays, including attapulgite and palygorskite clays, as suspension aids for liquid scouring cleansers. These patents are U.S. Pat. No. 4,051,055, issued to Trinh et al. on Sept. 27, 1977; and U.S. Pat. No. 4,005,027, issed to Hartman on Jan. 25, 1977. Again, however, the latter two references describe only aqueous suspensions, rather than nonaqueous or only slightly aqueous suspensions.

U.S. Pat. No. 4,166,039, issued to Wise on August 28, 1979, teaches that certain clays may be used to improve the homogeneity of crutcher mixes, but teaches that attapulgite clays are not useful for this purpose if the crutcher mixes contain a high proportion of a nonionic surfactant.

Several of the prior art references discuss ways in which to produce physically stable compositions which contain no water. U.S. Pat. No. 4,018,720, issued to Lengyel et al. on April 19, 1977, and U.S. Pat. No. 2,864,770, issued to McCune on Dec. 16, 1958, each contemplate the use of a nonionic surfactant as the vehicle in a detergent mull, but require at least some of the suspended builders to be in the form of very small particles in order to produce a stable composition. U.S. Pat. No. 3,630,929, issued to van Dijk on Dec. 28, 1971, teaches the use of highly voluminous inorganic carrier materials such as silica, alumina, magnesia, ferric oxide, titanium oxide, and the like as suspending agents for a very high proportion of an insoluble builder material in a paste consisting largely of a liquid detergent surfactant. No clays are disclosed in van Dijk as carrier materials. Also, the van Dijk reference states that the particle size of the suspended particles must be less than about 300 microns, preferably less than about 200 microns, in order for the suspension to be stable. United Kingdom patent application No. 2,017,072, filed by NL Industries, Inc., published Sept. 28, 1979, teaches the use of certain quaternary ammonium clays as suspending agents in nonaqueous systems.

Three references teach the use of unrelated clays as suspending agents. They are U.S. Pat. No. 3,259,574, issued to Morrison et al. on July 5, 1966; U.S. Pat. No. 3,557,037, issued to Collins et al. on Jan. 19, 1971; and U.S. Pat. No. 3,549,542 issued to Holderby on Dec. 22, 1970. Finally, the following references show the use of clays in unrelated contexts, particularly in fabric softening: U.S. Pat. No. 3,954,632, issued to Gloss on May 4, 1976; U.S. Pat. No. 3,948,790, issued to Speakman on Apr. 6, 1976; and British Pat. No. 1,519,605, issued to Perruchot on Aug. 2, 1978.

DISCLOSURE OF THE INVENTION

The present invention is a liquid mull having a liquid phase and a dispersed solid phase.

The liquid phase as a whole should have a liquid form at the temperature of use. The liquid phase is primarily comprised of 30% to 95%, preferably 40% to 75%, more preferably 40% to 60%, and most preferably about 54% of a nonionic surfactant. (Unless otherwise specified hereinafter, all percentage figures refer to percentage by weight of the entire composition.)

The dispersed solid phase of the composition includes 1% to 65%, preferably 15% to 55%, more preferably 20% to 45%, and most preferably about 35% of a dispersed particulate material which is insoluble in the liquid phase of the mull. In the preferred mode of the present invention, the dispersed particulate material is a material which is useful in detergency, such as a builder, a bleach, an enzyme, or another detergent component. It will be noted, however, that the chemical identity of the dispersed particulate material is not considered to be critical to the present invention, so long as this material is compatible with the other materials in the composition.

As its primary suspending agent, the composition of the present invention contains 1% to 15%, preferably 2% to 12%, more preferably 4% to 10%, and most preferably about 8% of an impalpable chain structure type clay. The chain structure type clays include sepiolite, attapulgite, and palygorskite clays. The attapulgite or sepiolite clays, and particularly the sepiolite clays, are preferred clays for use herein. This primary suspending agent forms a part of the dispersed solid phase of the composition.

Although the above components are the essential components of compositions of the present invention, the mulls of the present invention may further comprise a suspension aid selected from anionic surfactants, cationic surfactants, zwitterionic surfactants, and hydrotropic materials.

The mulls of the present invention may contain water, but in preferred compositions there is substantially no water present. Although limited amounts of water may occasionally aid the stability of the compositions, it is frequently desirable to produce compositions which contain bleaches or enzymes or other materials which are water sensitive, and in these cases the use of water is not desirable. A principal advantage of the present invention is that it allows the formulation of anhydrous compositions.

The balance of the mull may contain any of the optional ingredients normally or desirably included in detergent compositions. Specific optional ingredients which are preferred herein are described hereinafter in the specification.

DETAILED DESCRIPTION OF THE PREFERRED EMBODIMENTS

What follows is a detailed description of preferred embodiments of the present invention. While a number of exemplary compositions and variations thereon are specifically described in the specification, the invention is not limited to these specific embodiments. Rather, the scope of the invention is defined in the claims concluding this specification, which distinctly point out what is regarded to be the invention. The purpose of the teaching set forth immediately below is to enable those skilled in the art to practice the present invention, and to realize the best mode of practicing the invention.

In order to facilitate the discussion which follows, it will be useful at this point to define several terms as they are used herein.

A "liquid mull" is defined herein as a concentrated suspension of particulate solids in a liquid vehicle. The mulls as described herein are characterized by a water content of less than about 10%, and in preferred embodiments of the invention the mulls are anhydrous.

By a "chain structure type clay" is meant a clay material selected from the attapulgite, sepiolite, and palygorskite type clays. This class of clay materials is so named because, in bulk form, these clays exhibit a fiber-like structure which is believed by the inventors to be unique to the clays useful in the present invention.

A "hydrotrope" is defined herein as a material which has the structure of an anionic surfactant, except that the chain length of the alkyl moiety of the material is insufficient to allow the material to be used as a surfactant. While hydrotropes are ordinarily materials used to enable a water-insoluble organic material to be dissolved in water, in the present case the materials denoted as hydrotropes are not necessarily used to perform this function.

A "substantially anhydrous" material is one which contains no more than 1% water.

The present invention is a liquid mull having a liquid phase and a dispersed solid phase. In general, the mull comprises the following ingredients: (a) 30% to 95% of a liquid nonionic surfactant; (b) 1% to 65% of a dispersed particulate material which is insoluble in the liquid phase of the mull; and (c) 1% to 15% of a chain structure type clay. The mull can optionally further comprise water or an auxiliary suspension aid selected from anionic surfactants, cationic surfactants, zwitterionic surfactants, and hydrotropic materials. Preferably, the composition does not comprise more than 25% of the auxiliary suspension aid, nor more than 10% water. The balance of the mull can comprise any of the ingredients known to be useful in the detergent arts. In the description that follows the identity of each of these components will be addressed individually.

LIQUID PHASE

As noted above, 30% to 95%, preferably 40% to 75%, more preferably 40% to 60%, and most preferably about 54% of the liquid mulls of the present invention comprise a liquid nonionic surfactant. This choice of a surfactant as a predominant part of the liquid phase serves two purposes in the preferred embodiments of the present invention. First, it will be noted that the suspensions of the present invention contain a high proportion of surfactants. The use of a single ingredient both as a surfactant and as the majority of the liquid vehicle for the suspended solids obviously allows one to formulate a very compact composition, which is needed only in small quantities in order to wash a load of fabrics (in the context of laundry detergents), or in order to perform whatever other functions the composition is intended to perform. Thus, compactness of the composition is a first advantage of using a nonionic surfactant as part or all of the liquid vehicle of the composition.

A second advantage of using a surfactant as a major proportion of the vehicle is that it is frequently desirable to exclude water from a liquid composition. This is particularly true when it is necessary to put a water sensitive material in the composition. For example, several enzyme compositions are described below which are desirable for use in detergent compositions. However, the art has long recognized that these materials must be isolated from water in order to prevent them from rapidly decomposing and thus becoming useless. The same problem has also been noted for peroxygen or chlorine bleaches, although it will be appreciated that many bleaches must be encapsulated if they are to be stored in contact with an organic material such as a nonionic surfactant. In such compositions which contain very little water, a peroxygen bleach or enzyme, or any other component, may be encapsulated in a water-soluble material which is insoluble in the vehicle. An impervious encapsulated particle is thus provided which is easily dissolved in a laundry liquor when the mull is used to wash fabrics.

A third advantage of using a single ingredient both as a surfactant and as a major part of the vehicle is that the formula may be made and handled more economically.

NONIONIC SURFACTANTS

A wide variety of nonionic surfactants may be selected for use in the liquid vehicle in the present invention. The only requirements are that the nonionic surfactant (which may be a combination of nonionic surfactants) should be a liquid at the temperature of use, which is usually room temperature. It is, of course, highly preferred that the nonionic surfactant should contribute to the washing result to be achieved by the mull when the same is used in a laundry liquor to wash fabrics or is used to perform another function for which liquid detergents are commonly employed.

Nonionic surface active agents useful in the instant compositions are of three basic types—alkylene oxide condensates, amides and semi-polar nonionics.

The alkylene oxide condensates are broadly defined as compounds produced by the condensation of alkylene oxide groups (hydrophilic in nature) with an organic hydrophobic compound, which can be aliphatic or alkyl aromatic in nature. The length of the hydrophilic polyoxyalkylene radical which is condensed with any particular hydrophobic group can be readily adjusted to yield the desired degree of balance between hydrophilic and hydrophobic elements.

Examples of such alkylene oxide condensates include:

1. The condensation products of aliphatic alcohols with ethylene oxide. The alkyl chain of the aliphatic alcohol can either be straight or branched and generally contains from about 8 to about 22 carbon atoms. The chain of ethylene oxide can contain from 2 to 30 ethylene oxide moieties per molecule of surfactant. Examples of such ethoxylated alcohols include the condensation product of about 6 moles of ethylene oxide with 1 mole of tridecanol, myristyl alcohol condensed with about 10 moles of ethylene oxide per mole of myristyl alcohol, the condensation product of ethylene oxide with coconut fatty alcohol wherein the coconut alcohol is a mixture of fatty alcohols with alkyl chains varying from 10 to 14 carbon atoms and wherein the condensate contains about 5 moles of ethylene oxide per mole of alcohol, and the condensation product of about 9 moles of ethylene oxide with the above-described coconut alcohol. Examples of commercially available nonionic surfactants of this type include Tergitol 15-S-5 marketed by the Union Carbide Corporation, Neodol 23-5 marketed by the Shell Chemical Company and Kyro EOB marketed by The Procter & Gamble Company.

2. The polyethylene oxide condensates of alkyl phenols. These compounds include the condensation products of alkyl phenols having an alkyl group containing from about 6 to 12 carbon atoms, in either a straight chain or branched chain configuration, with ethylene oxide in amounts equal to 5 to 25 moles of ethylene oxide per mole of alkyl phenol. The alkyl substituent in such compounds can be derived, for example, from polymerized propylene, diisobutylene, octene, or nonene. Examples of compounds of this type include nonyl phenol condensed with about 9.5 moles of ethylene oxide per mole of nonyl phenol, dodecyl phenol condensed with about 12 moles of ethylene oxide per mole of phenol, dinonyl phenol condensed with about 15 moles of ethylene oxide per mole of phenol, di-isooctylphenol condensed with about 15 moles of ethylene oxide per mole of phenol. Commercially available nonionic surfactants of this type include Igepal CO-610 marketed by the GAF Corporation; Surfonic N-95, marketed by Jefferson Chemical Co., Inc.; and Triton X-45, X-100 and X-102, all marketed by Rohm and Haas Company.

3. The condensation products of ethylene oxide with a hydrophobic base formed by the condensation of propylene oxide with propylene glycol. The hydrophobic portion of these compounds has a molecular weight of from about 1,500 to 1,800 and of course exhibits poor water solubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product. Examples of compounds of this type include certain of the commercially available Pluronic surfactants marketed by the Wyandotte Chemicals Corporation.

4. The condensation products of ethylene oxide with the product resulting from the reaction of propylene oxide and ethylene diamine. The hydrophobic base of these products consists of the reaction product of ethylene diamine and excess propylene oxide, said base having a molecular weight of from about 2,500 to about 3,000. This base is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic compounds marketed by the Wyandotte Chemicals Corporation.

The amide type of nonionic surface active agents are a second class of nonionic surfactants, and may be characterized as the ammonia, monoethanol and diethanol amides of fatty acids having an acyl moiety of from about 7 to about 18 carbon atoms. These acyl moieties are normally derived from naturally occurring glycerides, e.g., coconut oil, palm oil, soybean oil and tallow, but can be derived synthetically, e.g., by the oxidation of petroleum, or by the Fischer-Tropsch process.

The amide surfactants useful herein may be selected from those aliphatic amides of the general formula:

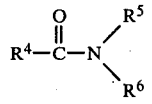

wherein $R^4$ is hydrogen, alkyl, or alkylol and $R^5$ and $R^6$ are each hydrogen, $C_2$–$C_4$ alkyl, $C_2$–$C_4$ alkylol, or $C_2$–$C_4$ alkylenes joined through an oxygen atom, the total number of carbon atoms in $R^4$, $R^5$ and $R^6$ being from about 9 to about 25. A further description and detailed examples of these amide nonionic surfactants are contained in U.S. Pat. No. 4,070,309, issued to Jacobsen on Jan. 24, 1978. That patent is hereby incorporated herein by reference.

The semi-polar type of nonionic surface active agents are a third class of nonionic surfactants useful herein. The semi-polar surfactants include the amine oxides, phosphine oxides and sulfoxides.

The amine oxides are tertiary amine oxides corresponding to the general formula:

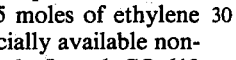

in which $R^1$ is an alkyl radical of from about 8 to about 18 carbon atoms; $R^2$ is an alkylene or a hydroxy alkylene group containing 2 to 3 carbon atoms; n ranges from 0 to about 20; and each $R^3$ is selected from the group selected from alkyl or hydroxyalkyl of 1–3 carbon atoms and mixtures thereof. The arrow in the formula is a conventional representation of a semi-polar bond. The preferred amine oxide detergents are selected from the coconut or tallow alkyl di- (lower alkyl) amine oxides, specific examples of which are dodecyldimethylamine oxide, tridecyldimethylamine oxide, tetradecyldimethylamine oxide, pentadecyldimethylamine oxide, hexadecyldimethylamine oxide, heptadecyldimethylamine oxide, octadecyldimethylamine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Suitable semi-polar nonionic detergents also include the water-soluble phosphine oxides having the following structure:

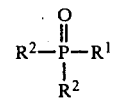

wherein $R^1$ is an alkyl or hydroxyalkyl moiety of 8 to 28 carbon atoms, preferably 8 to 16 carbon atoms and each $R^2$ is an alkyl moiety separately selected from the group consisting of alkyl groups and hydroxyalkyl groups containing 1 to 3 carbon atoms. Examples of suitable phosphine oxides include dimethyldecylphosphine oxide, dimethyltetradecylphosphine oxide, methylethyltetradecylphosphine oxide, dimethylhexadecylphosphine oxide, diethyl-2-hydroxyoctyldecylphosphine oxide, bis(2-hydroxyethyl)dodecylphosphine oxide, and bis(hydroxymethyl)tetradecylphosphine oxide.

The semi-polar nonionic detergents useful herein also include the water-soluble sulfoxide detergents, which have the structure:

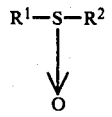

wherein $R^1$ is an alkyl or hydroxyalkyl moiety of 8 to 18 carbon atoms, preferably 12 to 16 carbon atoms and $R^2$ is an alkyl moiety selected from the group consisting of alkyl and hydroxyalkyl groups having 1 to 3 carbon atoms. Specific examples of the sulfoxides include dodecylmethyl sulfoxide, 2-hydroxyethyltridecyl sulfoxide, hexadecylmethyl sulfoxide, 3-hydroxyoctadecylethyl sulfoxide.

Some semi-polar nonionic surfactants, particularly the amine oxide surfactants, are less preferred for use herein because they are commercially available only in fairly dilute aqueous form and thus may introduce unwanted water into the composition. However, to the extent that semi-polar surfactants may be obtained in concentrated form, or may be mixed with more anhydrous nonionic surfactants, they may still be used in compositions embodying the present invention.

Preferred nonionic surfactants for use herein have an HLB (hydrophilic/lipophilic balance) of from about 7 to about 16, and are selected from the polyethylene oxide condensates of aliphatic alcohols, polyethylene oxide condensates of alkyl phenols, and mixtures thereof. The preferred polyethylene oxide condensates of aliphatic alcohols have an alcohol moiety which is a straight chain hydrocarbon alcohol with an average chain length of 9 to 15 carbon atoms, preferably 11 to 15 carbon atoms, and most preferably 12 to 13 carbon atoms. These preferred polyethylene oxide condensates of aliphatic alcohols have an ethylene oxide chain length of 3 to 15 ethylene oxide moieties, preferably from about 3 to about 7 ethylene oxide moieties, and more preferably an average of 5 ethylene oxide moieties per molecule of surfactant. Thus, one particularly preferred surfactant for use herein is a condensate of a straight chain hydrocarbon alcohol having 12 to 13 carbon atoms, condensed with an average of 5 moles of ethylene oxide per molecule of surfactant. This material is commercially available as Neodol 23-5 from Shell Chemical Company.

Of the polyethylene oxide condensates of alkyl phenols, preferred species have an alkyl chain length of from 8 to 9 carbon atoms and an average ethylene oxide chain length of 3 to 15 ethylene oxide moieties.

SOLVENTS

The liquid phase may optionally include any solvent known to the art, such as (but not limited to) hydrocarbon, alkylene glycol or alcohol solvents. Alkanes, the lower hydrocarbon alcohols or ethylene or propylene glycol are specific solvents which may be used.

DISPERSED SOLID PHASE

The detergent mulls of the present invention include 1% to 65%, preferably 15% to 55%, more preferably 20% to 45%, and most preferably about 35% of a dispersed particulate material which is insoluble in the liquid phase of the mull. This insoluble particulate material is typically most of the dispersed solid phase of the mull. In fact, the essence of the present invention is that large amounts of an insoluble particulate material may be suspended in a liquid mull. The prior art does not teach one how to formulate a liquid mull with such a high proportion of a dispersed particulate material, without regard to the particle size suspended.

The dispersed particulate material may be any chemical compound or mixture which is insoluble in the balance of the mull. Of course, it is highly desirable to use particulate materials which are physically and chemically stable. The dispersed particulate material does not need to include very small particles in order for the present invention to be operable. The inventors have found that in some formulations the particle size of the dispersed particulate material may be as large as (or larger than) 350 microns, which is larger than the particle size of commonly used builders and other detergent adjuvant materials. The inventors do not know of any upper limit to the diameter of particles which may be suspended in accordance with the present invention. Individual particles larger than 1 millimeter in diameter have been successfully suspended in some instances.

BUILDERS

In a highly preferred embodiment of the present invention, most of the dispersed particulate material comprises a detergency builder in solid form.

The builders used in the heavy duty detergent compositions of this invention can be any of the organic or inorganic builder salts described below. Suitable inorganic builder salts useful herein include alkali metal carbonates, bicarbonates, borates, aluminates, phosphates, polyphosphates, sulfates, chlorides and silicates. Specific examples of these salts are sodium or potassium tripolyphosphate, tetraborate, perborate, aluminate, carbonate, bicarbonate, orthophosphate, pyrophosphate, sulfate and hexametaphosphate. Zeolites are another class of inorganic builders.

A further class of inorganic detergency builder materials useful in the present invention are insoluble sodium aluminosilicates, particularly those described in Belgian Pat. No. 814,874, issued Nov. 12, 1974, hereby incorporated herein by reference. This patent discloses and claims detergent compositions containing sodium aluminosilicates having the formula $$Na_z(AlO_2)_z(SiO_2)_yXH_2O,$$

wherein z and y are integers equal to at least 6, the molar ratio of z to y is in the range of from 1.0:1 to about 0.1:1, and X is an integer from about 15 to about 264, said aluminosilicates having a calcium ion exchange capacity of at least 200 milligrams equivalent/gram and a calcium ion exchange rate of at least about 2 grains/gallon/minute/gram. A preferred material is $$Na_{12}(SiO_2AlO_2)_{12}27H_2O$$

Suitable organic builder salts include the alkali metal, ammonium and substituted ammonium polyphosphonates, polyacetates, and polycarboxylates.

The polyphosphonates specifically include the sodium, lithium and potassium salts of ethylene diphosphonic acid, sodium and potassium salts of ethane-1-hydroxy-1,1-diphosphonic acid and sodium and potassium salts of ethane-1,1,2-triphosphonic acid. Other examples include the water-soluble [sodium, potassium, ammonium and substituted ammonium (substituted ammonium, as used herein, includes mono-, di-, and triethanol ammonium cations)] salts of ethane-2-carboxy-1,1-diphosphonic acid, hydroxymethanediphosphonic acid, carbonyldiphosphonic acid, ethane-1-hydroxy-1, 1,2-triphosphonic acid, ethane-2-hydroxy-1,1,2-triphosphonic acid, propane-1,1,3,3-tetraphosphonic acid, propane-1,1,2,3-tetraphosphonic acid, nitrilotrimethylene phosphonic acid, ethylene diamine tetra(methylene phosphonic acid), and diethylene triamine penta(methylene phosphonic acid). Examples of these polyphosphonic compounds are disclosed in British Pat. Nos. 1,026,366, 1,035,913, 1,129,687, 1,136,619 and 1,140,980. For more examples, see U.S. Pat. No. 3,213,030, issued to Diehl on Oct. 19, 1965; U.S. Pat. No. 3,433,021, issued to Roy on Jan. 14, 1968; U.S. Pat. No. 3,292,121, issued Gedge on Jan. 9, 1968; and U.S. Pat. No. 2,599,807, issued to Bersworth on June 10, 1952.

Polyacetate builder salts suitable for use herein include the sodium, potassium lithium, ammonium, and substituted ammonium salts of the following acids:ethylenediaminetriacetic acid, n-(2-hydroxyethyl)-nitrilodiacetic acid, diethylenetriaminepentaacetic acid, 1,2-diaminocyclohexanetetraacetic acid and nitrilotriacetic acid. The trisodium salts of the above acids are generally preferred.

The polycarboxylate builder salts suitable for use herein consist of water-soluble salts of polymeric aliphatic polycarboxylic acids as, for example, described in U.S. Pat. No. 3,308,067, issued to Diehl on Mar. 7, 1967; this patent is hereby incorporated herein by reference.

Further polycarboxylate builder salts useful herein are polymeric materials having a molecular weight of from 2000 to 2,000,000 which are copolymers of maleic acid or anhydride and a polymerisable monomer selected from compounds of the formula:

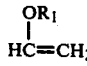

wherein $R_1$ is $CH_3$ or a $C_2$ to $C_{12}$ alkyl group;

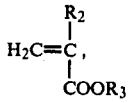

wherein $R_2$ is H or $CH_3$ and $R_3$ is H or a $C_1$ to $C_{10}$ alkyl group;

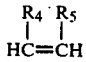

wherein each of $R_4$ and $R_5$ is H or an alkyl group such that $R_4$ and $R_5$ together have 0 to 10 carbon atoms;

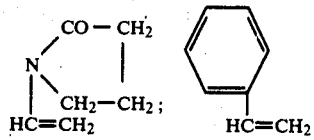

and mixtures of any two or more thereof, said copolymers being optionally wholly or partly neutralized at the carboxyl groups by sodium or potassium.

Highly preferred examples of such carboxylates are 1:1 styrene/maleic acid copolymers, di-isobutylene/-maleic acid copolymers and methyl vinyl ether/maleic acid copolymers.

Other suitable polycarboxylates are poly-α-hydroxy acrylic acids of the general formula:

$$-[-CR_1R_2-C(OH)-(COOH)-]_n-$$

wherein $R_1$ and $R_2$ each represent a hydrogen atom or an alkyl group containing 1, 2 or 3 carbon atoms and wherein n represents an integer greater than 3. Such materials may be prepared as described in Belgian Pat. No. 817,678. Also suitable are polylactones prepared from the hydroxy acids as described in British Pat. No. 1,425,307.

Additional detergent builder salts for use in the compositions of the instant invention include the water-soluble salts of amino polycarboxylates, ether polycarboxylates, citric acid, phytic acid and other polyacids.

The water-soluble amino-polycarboxylate compounds have the structural formula:

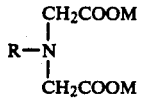

wherein R is selected from:

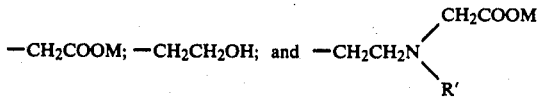

wherein R′ is

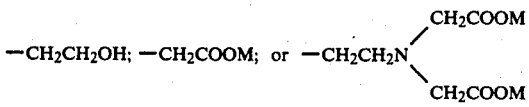

and each M is selected from hydrogen and a salt-forming cation.

The water-soluble ether polycarboxylates have the formula:

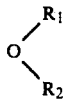

wherein $R_1$ is selected from:

$-CH_2COOM$; $-CH_2CH_2COOM$;

-continued

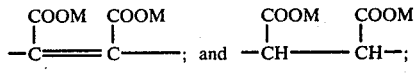

and $R_2$ is selected from:

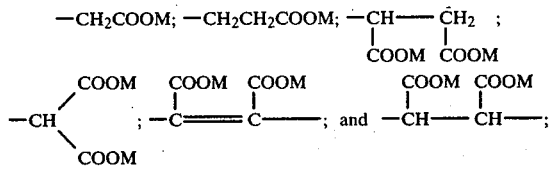

wherein $R_1$ and $R_2$ form a closed ring structure in the event said moieties are selected from:

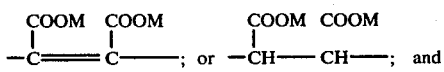

each M is selected from hydrogen and a salt-forming cation.

Specific examples of this class of carboxylate builders include the water-soluble salts of oxydiacetic acid having the formula:

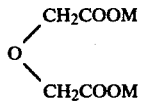

oxydisuccinic acid, having the formula:

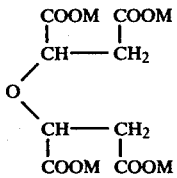

carboxy methyl oxysuccinic acid, having the formula:

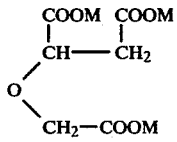

furan tetracarboxylic acid, having the formula:

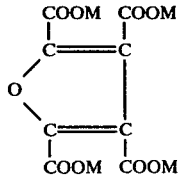

and tetrahydrofuran tetracarboxylic acid, having the formula:

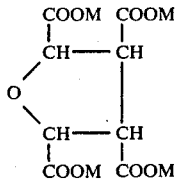

The salt-forming cation M can be represented, for example, by alkali metal cations such as potassium, lithium and sodium and also by ammonium and ammonium derivatives.

Water-soluble polycarboxylic builder salts derived from citric acid constitute another class of a preferred builder for use herein. Citric acid, also known as 2-hydroxypropane-1,2,3-tricarboxylic acid, has the formula:

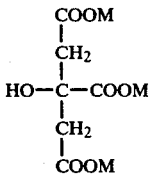

Citric acid occurs in a free state in nature. Large quantities of it are also produced, for example, as a by-product of sugar derived from sugar beets. In the compositions of this invention, it can be desirable to use the free acid or a partially neutralized species wherein the neutralizing cation, M, is preferably selected from alkali metal ions such as sodium, potassium, lithium and from ammonium and substituted ammonium.

Several other polyacids useful herein as builders are disclosed in U.S. Pat. No. 4,110,262, issued to Arnau et al. on Aug. 29, 1978. That patent is hereby incorporated herein by reference.

ENZYMES

The dispersed particulate materials of the present invention may also consist wholly, or more usually partially of enzyme materials. The enzymes of this invention are solid, catalytically active protein materials which degrade or alter one or more types of soil or stains encountered in laundering situations so as to remove the soil or stain from the fabric or object being laundered or to make the soil or stain more removable in a subsequent laundering step. Both degradation and alteration improve soil removability. As used herein, enzyme activity refers to the ability of an enzyme to perform the desired function of soil attack and enzyme stability refers to the ability of an enzyme to remain in an active state.

A large number of enzyme materials are described in U.S. Pat. No. 3,519,570, issued to McCarty on July 7, 1970. That patent is hereby incorporated herein by reference in its entirety. In addition to those enzymes listed in the McCarty patent, the enzymes herein also can be proteases produced by the bacterium strains referred to in the specification of Belgian Pat. No. 721,730, Table IX, Type 1, and which have been deposited under NCIB numbers and also those enzymes derived from strains of bacillus alcalophilus. Some examples are the proteases produced by strains deposited under NCIB numbers 10147, 10313, 10315, 10317 and 8772.

The McCarty patent also describes a number of specific commercial enzyme compositions which are useful for use herein. Of those, the enzymes marketed under the registered trademarks MAXITASE and AMYLASE are preferred. Another composition which is especially preferred as an enzyme herein is sold under the registered trademark MAXAZYME by the manufacturers of MAXITASE, listed in the McCarty patent.

If present, the enzymes should be used in an amount sufficient to provide substantial enzyme activity to the composition. Useful ranges of enzyme activity are from about 0.01 to 0.15 Anson units per gram of the mull, preferably from 0.01 to 0.10 Anson units per gram of said mull, and most preferably roughly 0.075 Anson units per gram of said mull. This level of activity may be accomplished, for example, by adding to the composition about 2% of the commercial material marketed as MAXAZYME.

BLEACHES

The dispersed particulate materials useful herein may include peroxygen or chlorine laundry bleaches. Such bleaches, if used, can comprise 1% to 50% of the mull. If a peroxygen bleach is selected for use herein, it preferably comprises 5% to 35% of the mull, and more preferably comprises about 20% of the mull in the case of inorganic peroxygen bleaches and about 10% of the mull in the case of organic bleaches. If a chlorine bleach is selected for use herein, the bleach preferably comprises about 1% to about 10% of the mull.

It will be appreciated by those skilled in the art that of the bleaches described herein, some are unstable with respect to nonionic surfactants and other potential materials of the present compositions. Therefore, it will usually be necessary to encapsulate these bleach materials in order to produce a chemically stable detergent mull of the present invention. Encapsulating methods, as well as other ways of isolating the dispersed bleaches from the rest of the composition, are well known to those skilled in the art. It will be noted that a particular advantage of the present invention, in which the detergent mulls may be substantially anhydrous while the laundry liquor consists primarily of water, is that the encapsulating material may be a material which is soluble in water but insoluble in the detergent mull. This will allow the incorporation in the composition of many bleaches which cannot be incorporated in aqueous liquids which contain nonionic surfactants.

Bleaches useful herein include the peroxygen bleaches. While any of the solid peroxygen bleaches known to the art may be used herein, preferred peroxygen bleaches for use herein are selected from alpha-omega diperoxyacids having chain lengths of from 6 to 16 carbon atoms; alkali metal perborates, persulfates, persilicates, perphosphates, and percarbonates; alkyl mono- and diperoxysuccinic acids having alkyl chain lengths of from 8 to 18 carbon atoms; benzoyl peroxide and mixtures thereof.

If any of the above inorganic peroxy bleaches are to be used, it may also be desirable to include, in the dispersed particulate material of the mull, an inorganic peroxy compound activator. Inorganic peroxy compound activators are well known in the art and are described extensively in the literature.

Examples of various classes of peroxy compound activators follow:

One class of peroxy compound activators useful herein is that of anhydrides. These can be aliphatic, aromatic or mixed and can be derived from mono- or polycarboxylic acids. Preferred aliphatic anhydrides have individual aliphatic groups containing 1–12 carbon atoms and mixed aliphatic anhydrides should contain no more than 20 carbon atoms. Specific aliphatic anhydrides include acetic, propionic, butyric, heptanoic, nonanoic, acetic-hexadecanoic, acetic-stearic and butyric-myristic anhydrides.

Aromatic anhydrides can be substituted or unsubstituted, preferred examples being benzoic, phthalic and pyromellitic anhydrides and their nucleosubstituted halo, nitro and alkoxy analogues such as 2,4-dichloro benzoic anhydride, m-chloro benzoic anhydride and p-methoxy benzoic anhydride.

Mixed aliphatic-aromatic anhydrides are also useful in the present invention provided that they contain no more than 12 carbon atoms in the molecule, examples being benzoic-acetic anhydride and benzoic propionic anhydride. Other useful anhydrides include the cyclic anhydrides such as maleic, succinic, glutaric, adipic and itaconic anhydrides and polymeric anhydrides such as polyadipic and polyazelaic polyanhydrides of the formula:

$$HOOC-(CH_2)_p-\overset{O}{\overset{\|}{C}}-O\left[-\overset{O}{\overset{\|}{C}}-(CH_2)_p-\overset{O}{\overset{\|}{C}}-O\right]_q-\overset{O}{\overset{\|}{C}}-(CH_2)_p-COOH$$

wherein p is preferably 4 to 7 and q has a value between 5 and 15, preferably from 7 to 8.

U.S. Pat. No. 2,362,401, issued to Reichert on Nov. 7, 1944, describes the use of certain organic anhydrides as perborate activators in detergent compositions. That reference is hereby incorporated herein by reference.

Esters suitable as peroxy compound activators in the present invention include esters of the following: monohydric substituted and unsubstituted phenols; substituted aliphatic alcohols in which the substituent group is electron withdrawing in character; mono- and disaccharides; N-substituted derivatives of hydroxylamine and imidic acids.

The phenyl esters of both aromatic and aliphatic mono- and dicarboxylic acids can be employed. The aliphatic esters can have 1 to 20 carbon atoms in the acyl group, examples being phenyl acetate, phenyl laurate, phenyl myristate, phenyl palmitate and phenyl stearate. Of these, o-acetoxy benzoic acid and methyl o-acetoxy benzoate are especially preferred. Diphenyl succinate, diphenyl azeleate and diphenyl adipate are examples of phenyl aliphatic dicarboxylic acid esters. Aromatic phenyl esters include phenyl benzoate, diphenyl phthalate and diphenyl isophthalate.

A specific example of an ester of a substituted aliphatic alcohol is trichloroethyl acetate. Examples of saccharide esters include glucose penta-acetate and sucrose octa-acetate. An exemplary ester of hydroxylamine is acetyl aceto-hydroxamic acid.

Esters of imidic acids have the general formula:

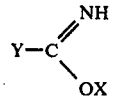

wherein X is substituted or unsubstituted $C_1$–$C_{20}$ alkyl or aryl and Y can be the same as X and can also be —$NH_2$. An example of this class of compounds is ethyl benzimidate wherein Y is $C_6H_5$ and X is ethyl.

These and other esters suitable for use as peroxy compound precursors in the present invention are fully described in British Pat. Nos. 836,988 and 839,715.

A further group of esters are the acyl phenol sulphonates and acyl alkyl phenol sulphonates. Examples of the former include sodium acetyl phenol sulphonate (alternatively described as sodium p-acetoxy benzene sulphonate) and sodium benzoyl phenol sulphonate (alternatively described as sodium p-benzoyloxy benzene sulphonate). Examples of acyl alkyl phenol sulphonates include sodium 2-acetoxy 5-dodecyl benzene sulphonate, sodium 2-acetoxy 5-hexyl benzene sulphonate and sodium 2-acetoxy capryl benzene sulphonate. The preparation and use of these and analogous compounds is given in British Pat. Nos. 963,135 and 1,147,871, both specifically incorporated herein by reference.

Acetylated esters of phosphoric acid have also been suggested as organic peroxy compound precursors, examples being diethyl monoacetyl orthophosphate and diacetyl ethyl orthophosphate.

Other specific esters include p-acetoxy acetophenone and 2,2-di-(4-hydroxyphenyl) propane diacetate. This last material is the diacetate derivative of 2,2-di(4-hydroxyphenyl) propane, more commonly known as Bisphenol A, which is an intermediate in the manufacture of polycarbonate resins. Bisphenol A diacetate and methods for its manufacture are disclosed in German DAS No. 1,260,479, published Feb. 8, 1968, in the name of VEB chemiefaserwerk Schwarza "Wilhelm Piesh," the disclosure of which is hereby incorporated herein by reference.

Imides suitable as peroxy compound activators in the present invention are compounds of the formula:

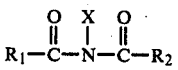

wherein $R_1$ and $R_2$, which can be the same or different, are independently chosen from a $C_1$–$C_4$ alkyl group or an aryl group and X is an alkyl, aryl or acyl radical (either carboxylic or sulphonic). Typical compounds are those in which $R_1$ is a methyl, ethyl, propyl or phenyl group, but the preferred compounds are those in which $R_2$ is also methyl, examples of such compounds being N,N-diacetylaniline, N,N-diacetyl-p-chloroaniline and N,N-diacetyl-p-toluidine. Either one of $R_1$ and $R_2$ together with X may form a heterocyclic ring containing the nitrogen atom. An illustrative class having this type of structure is the N-acyl lactams, in which the nitrogen atom is attached to two acyl groups, one of which is also attached to the nitrogen in a second position through a hydrocarbyl linkage. A particularly preferred example of this class is N-acetyl caprolactam. The linkage of the acyl group to form a heterocyclic ring may itself include a heteroatom, for example oxygen, and N-acyl saccharides are a class of precursors of this type.

Examples of cyclic imides in which the reactive center is a sulphonic radical are N-benzene sulphonyl phthalimide, N-methanesulphonyl succinimide and N-benzene sulphonyl succinimide. These and other N-sulphonyl imides useful herein are described in British Pat. No. 1,242,287.

Attachment of the nitrogen atoms to three acyl groups occurs in the N-acylated dicarboxylic acid imides such as the N-acyl phthalimides, N-acyl succinimides, N-acyl adipimides and N-acyl glutarimides. Imides of the abovementioned types are described in British Pat. No. 855,735.

Two further preferred groups of materials in this class are those in which X in the above formula is either a second diacylated nitrogen atom, i.e., substituted hydrazines, or a difunctional hydrocarbyl group such as a $C_1$–$C_6$ alkylene group further substituted with a diacylated nitrogen atom, i.e., tetraacylated alkylene diamines.

Particularly preferred compounds are N,N,N',N'-tetraacetylated compounds of the formula:

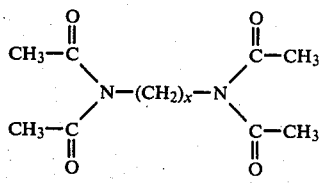

wherein x can be O or an integer between 1 and 6. Examples of these compounds are tetraacetyl methylene diamine (TAMD) where x=1, tetraacetyl ethylene diamine (TAED) where x=2, and tetraacetyl hexamethylene diamine (TAHD) where x=6. Where x=0 the compound is tetraacetyl hydrazine (TAH). These and analogous compounds are described in British Pat. Nos. 907,356, 907,357 and 907,358.

Acylated glycourils form a further group of compounds falling within the general class of imide peroxy compound activators. These materials have the general formula:

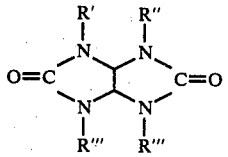

wherein at least two of the R groups represent acyl radicals having 2 to 8 carbon atoms in their structure. The preferred compound is tetra acetyl glycouril in which the R groups are all $CH_3CO$— radicals. The acylated glycourils are described in British Pat. Nos. 1,246,338, 1,246,339 and 1,247,429.

Other imide-type compounds suitable for use as peroxy compound activators in the present invention are the N-(halobenzoyl) imides disclosed in British Pat. No. 1,247,857, of which N-m-chloro benzoyl succinimide is a preferred example, and poly imides containing an N-bonded-COOR group, e.g., N-methoxy carbonyl phthalimide, disclosed in British Pat. No. 1,244,200.

N-acyl and N,N'-diacyl derivatives of urea are also useful peroxy compound activators for the purposes of the present invention, in particular N-acetyl dimethyl urea, N,N'-diacetyl ethylene urea and N,N'-diacetyl dimethyl urea. Compounds of this type are disclosed in Netherlands patent application No. 6,504,416, published Oct. 10, 1966. Other urea derivatives having inorganic persalt activating properties are the mono- or di-N-acylated azolinones disclosed in British Pat. No. 1,379,530.

Acylated hydantoin derivatives also fall within this general class of organic peroxy compound activators. The hydantoins may be substituted, e.g., with lower alkyl groups, and one or both nitrogen atoms may be acylated. Examples of compounds of this type are N-acetyl hydantoin, N,N-diacetyl hydantoin, 5,5-dimethyl hydantoin, 1-phenyl-3-acetyl hydantoin and 1-cyclohexyl-3-acetyl hydantoin. These and similar compounds are described in British Pat. Nos. 965,672 and 1,112,191.

Another class of nitrogen compounds of the imide type are the N,N-diacyl methylene diformamides of which N,N-diacetyl methylene diformamide is the preferred member. This material and analogous compounds are disclosed in British Pat. No. 1,106,666.

A further class of organic compounds suitable as peroxy compound activators in the present invention are those having the general formula:

$$X-C\equiv N$$

wherein X can be a substituted or unsubstituted alkyl or aryl group or can be $$-\underset{\underset{O}{\|}}{C}-A$$

wherein A is —OR or —$NR_1R_2$, each of $R_1R_1$ and $R_2$ being a lower alkyl or a substituted or unsubstituted aryl group.

This class of compounds differs from most of the other peroxy compound activators in that the reaction with inorganic persalts forms peroxy species other than peroxy acids.

Where X is a substituted or unsubstituted alkyl or aryl group, the compounds are nitriles, which may be mono- or poly-functional in type and whose efficacy increases as the number of cyano groups increases, provided that the compounds retain some solubility in water. Specific examples of organo-nitriles include phthalonitrile, benzonitrile, tetramethylene dinitrile, malonitrile, ethylene diamino tetraacetic dinitrile, nitrilo triacetic nitrile and succinonitrile. These and other similar compounds useful herein are fully described in British Pat. No. 802,035.

Compounds of the above formula in which X is —COOR or —$CONR_1R_2$ are disclosed in German patent application OLS No. 2,647,978, published Apr. 28, 1977.

N-acyl imidazoles and similar five-membered ring systems form a further series of compounds useful as inorganic peroxy compound activators. Specific examples are N-acetyl benzimidazole, N-benzoyl imidazole and its chloro- and methyl-analogues. Compounds of this type are disclosed in British Pat. Nos. 1,234,762, 1,311,765 and 1,395,760.

Oximes and particularly acylated oximes are also a useful class of peroxy compound activators for the purpose of this invention. Oximes are derivatives of hydroxylamine from which they can be prepared by reaction with aldehydes and ketones to give aldoximes and ketoximes, respectively. The acyl groups may be $C_1$–$C_{12}$ aliphatic or aromatic in character, preferred acyl groups being acetyl, propionyl, lauryl, myristyl and benzoyl. Compounds containing more than one carbonyl group can react with more than one equivalent of hydroxylamine. The commonest class of dioximes are those derived from 1,2-diketones and ketonic aldehydes, such as dimethyl glyoxime:

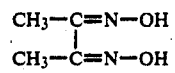

The acylated derivatives of this compound are of particular value as organic peroxy compound precursors, examples being diacetyl dimethyl glyoxime, dibenzoyl dimethyl glyoxime and phthaloyl dimethyl glyoxime.

Substituted and unsubstituted aliphatic, aromatic and alicyclic esters of carbonic and pyrocarbonic acid have also been proposed as peroxy compound activators. Typical examples of such esters are p-carboxy phenyl ethyl carbonate, sodium-p-sulphophenyl ethyl carbonate, sodium-p-sulphophenyl n-propyl carbonate and diethyl pyrocarbonate. The use of such esters as inorganic persalt activators in detergent compositions is set forth in British Pat. No. 970,950.

In addition to the foregoing classes, numerous other materials can be utilized as organic peroxy compound activators, including triacyl guanidines of the formula:

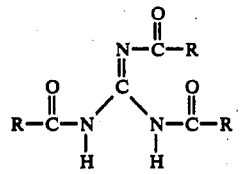

wherein R is alkyl (preferably acetyl) or phenyl, prepared by the acylation of a guanidine salt. Other classes of compounds include acyl sulphonamides, e.g., N-phenyl N-acetyl benzene sulphonamide as disclosed in British Pat. No. 1,003,310 and triazine derivatives such as those disclosed in British Pat. Nos. 1,104,891 and 1,410,555. Particularly preferred examples of triazine derivatives are the di- and triacetyl derivatives of 2,4,6trihydroxy 1,3,5-triazine, 2-chloro 4,6-dimethoxy-S-triazine and 3,4-dichloro 6-methoxy-S-triazine. Piperazine derivatives such as 1,4-diacylated 2,5-diketo piperazine as described in British Pat. Nos. 1,339,256 and 1,339,257 are also useful, as are water-soluble alkyl and aryl chloroformates such as methyl, ethyl and phenyl chloroformate disclosed in British Pat. No. 1,242,106.

Of the foregoing classes of activators, the preferred classes are those that produce a peroxycarboxylic acid on reaction with an inorganic persalt. In particular the preferred classes are the anhydrides, imides, oximes and esters, especially the phenol esters and imides.

Specific preferred materials include methyl o-acetoxy benzoate, sodium-p-acetoxy benzene sulphonate, Bisphenol A diacetate, tetraacetyl ethylene diamine, tetraacetyl hexamethylene diamine and tetraacetyl methylene diamine.

The level of usage of peroxy compound activators will naturally be dependent on a number of factors, e.g., the size of the fabric load in the machine, the level of bleaching performance desired, the amount of inorganic persalt in the conventional detergent product and the usage of the detergent product, the bleaching efficacy of the organic peroxy species derived from the activator and the efficiency of conversion of the activator into that peroxy species. For a machine having a liquid capacity in use of 20 to 30 liters, the weight of activator per delivery will normally lie in the range of 3 grams to 10 grams, preferably from 4 grams to 6 grams.

Chlorine bleaching agents may also be used as bleaching agents in the present invention. Any suitable bleaching agent which yields available chlorine in the form of a hypohalite is useful herein.

Those bleaching agents which yield a hypochlorite species in aqueous solution include alkali metal and alkaline earth metal hypochlorites, hypochlorite addition products, chloramines, chlorimines, chloramides, and chlorimides. Specific examples of compounds of this type include sodium hypochlorite, potassium hypochlorite, monobasic calcium hypochlorite, dibasic magnesium hypochlorite, chlorinated trisodium phosphate dodecahydrate, potassium dichloroisocyanurate, trichlorocyanuric acid, sodium dichloroisocyanurate, sodium dichloroisocyanurate dihydrate, 1,3-dichloro-5,5-dimethylhydantoin, N-chlorosulfamide, Chloramine T, Dichloramine T, Chloramine B and Dichloramine B. A preferred bleaching agent for use in the compositions of the instant invention is sodium hypochlorite.

Most of the above-described hypochlorite-yielding bleaching agents are available in solid or concentrated form.

BLEACH STABILIZING AGENTS

For liquid compositions of the present invention which contain a bleaching agent, bleaching agent stabilization is generally achieved by careful selection of bleaching agents, encapsulating materials and noninterfering surfactants and suspending agents.

For systems containing bleach, it can be desirable to include a stabilizer for the bleaching agents. For some types of bleaching agents, particularly oxygen bleaching agents, water-soluble bleach stabilizing agents can be selected from the group consisting of alkali metal, alkaline earth metal, ammonium and substituted ammonium salts of an acid having an ionization constant at 25° C., for the first hydrogen, of at least $1\times10^3$. Stabilizing salts include the alkali metal, alkaline earth metal, ammonium, and substituted ammonium sulfates, bisulfates, nitrates, phosphates, pyrophosphates, polyphosphates and hexametaphosphates. Specific examples of such materials include magnesium sulfate, sodium sulfate, potassium sulfate, ammonium sulfate, lithium sulfate, dimethylammonium sulfate, sodium bisulfate, potassium bisulfate, ammonium bisulfate, sodium nitrate, magnesium nitrate, calcium nitrate, sodium tripolyphosphate, trisodium phosphate, sodium metaphosphate, sodium hexametaphosphate, potassium pyrophosphate, and sodium tetraphosphate. Stabilizing agents of this type are described more fully in U.S. Pat. No. 3,639,285, issued to Nielsen on Feb. 1, 1972, hereby incorporated herein by reference.

For chlorine bleaching agents, particularly N-chloroimides, a highly preferred stabilizing agent is sodium acetate. Use of this material as a bleach stabilizer is described more fully in U.S. Pat. No. 3,829,385, issued to Abbott et al., on Aug. 13, 1974, incorporated herein by reference. Such stabilizing agents comprise from 0% to about 15% by weight of the composition.

CHAIN STRUCTURE TYPE CLAY

The mulls of the present invention comprise 1% to 15%, preferably 2% to 12%, more preferably 4% to 10% and most preferably about 8% of an impalpable clay characterized as a chain structure type clay. The particular clays which fall under this classification are the attapulgite, sepiolite, and palygorskite clays. The preferred clays are the sepiolite and attapulgite clays; the most preferred clay for use herein is sepiolite clay.

A detailed description of the chain structure type clays may be found in Grim, *Clay Mineralogy,* 2nd Ed. New York, McGraw-Hill, Inc., 1968. Library of Congress Catalog Card No. 67-24951. This work describes the chain structure type clays as hornblende-like chains of silica tetrahedrons linked together by octahedral groups of oxygens and hydroxyls containing aluminum and magnesium atoms. Grim suggests at page 14 that there are two distinct fibrous clay minerals under this classification: one type that has been called palygorskite, attapulgite, and/or pilolite; and a second type similar to sepiolite. Grim describes the chemical structure and depicts in photographs the physical structure of the clays useful herein as suspending aids. The entirety of the above Grim reference is hereby incorporated herein by reference.

Preferred commercially available clays for use herein as suspending agents include Imvite IGS, a commercial material comprising about 60% sepiolite clay sold by Mineral Ventures, and Attagel 50, a commercial material comprising about 75% attapulgite clay sold by Engelhard Minerals and Chemicals Company.

These chain structure type clays, when admixed with the other components of the instant invention, form compositions having false body properties. "False body" fluids are related to but are not identical to fluids having thixotropic properties. True thixotropic materials break down completely under the influence of high stresses and behave like true liquids even after the stress has been removed. False-bodied materials, on the other hand, do not, after stress removal, lose their solid properties entirely and can still exhibit a yield value even though it might be diminished. The original yield value is regained after these false-bodied fluids are allowed to remain at rest for a time.

The instant false-body mixtures in a quiescent state are highly viscous, are Bingham plastic in nature, and have relatively high yield values. When subjected to shear stresses, however, such as being pumped through a pipe, shaken in a bottle or squeezed through an orifice, the instant compositions fluidize and can be easily dispensed. When the shear stress is stopped, the instant clay containing compositions quickly revert to their high viscosity/Bingham plastic state, in which the dispersed solid phase is largely immobilized.

AUXILIARY SUSPENSION AID

In addition to chain structure type clays, the mulls of the present invention may also contain an auxiliary suspension aid selected from anionic surfactants, cationic surfactants, zwitterionic surfactants and hydrotropic materials. Preferred proportions of said auxiliary suspension aids are 0% to 25%, more narrowly 0% to 15%, more narrowly from 0% to 7%, and even more narrowly about 2% of the detergent mull. Specific materials useful as auxiliary suspension aids are described below.

ANIONIC SURFACTANTS

One type of material which may be used as an auxiliary suspension aid herein is any of the soap or non-soap anionic surfactants.

This class of surfactants includes ordinary alkali metal soaps such as the sodium, potassium, ammonium and alkanolammonium salts of higher fatty acids containing from about 8 to about 24 carbon atoms and preferably from about 10 to about 20 carbon atoms. In the present description, free fatty acids having from 8 to 24 carbon atoms shall also be considered to be anionic surfactants. Suitable fatty acids can be obtained from natural sources such as, for instance, plant or animal esters (e.g., palm oil, coconut oil, babassu oil, soybean oil, castor oil, tallow, whale and fish oils, grease, lard, and mixtures thereof). The fatty acids also can be synthetically prepared (e.g., by the oxidation of petroleum, or by the Fischer-Tropsch process). Resin acids are suitable such as rosin and those resin acids in tall oil. Naphthenic acids are also suitable. Sodium and potassium soaps can be made by direct saponification of the fats and oils or by the neutralization of the free fatty acids which are prepared in a separate manufacturing process. Particularly useful are the sodium and potassium salts of the mixtures of fatty acids derived from coconut oil and tallow, i.e., sodium or potassium tallow and coconut soap.

This class of anionic surfactants also includes water-soluble salts, particularly the alkali metal salts, of organic sulfuric reaction products having in their molecular structure an alkyl group containing from about 8 to about 22 carbon atoms and a sulfonic acid or sulfuric acid ester radical. (Included in the term alkyl is the alkyl portion of higher acyl groups.) Examples of this group of synthetic detergents are the water-soluble (i.e., sodium, potassium, magnesium or ammonium) alkyl sulfates, especially those obtained by sulfating the higher alcohols ($C_8$–$C_{18}$ carbon atoms) produced by reducing the glycerides of tallow or coconut oil; sodium or potassium alkyl benzene sulfonates, in which the alkyl group contains from about 8 to 18 carbon atoms in straight chain or branched chain configuration, e.g., those of the type described in U.S. Pat. No. 2,220,099 and 2,477,383 (especially valuable are linear straight chain alkyl benzene sulfonates in which the average chain length of the alkyl group is about 11.8 carbon atoms, commonly abbreviated as LAS); sodium alkyl glyceryl ether sulfonates, especially those ethers of higher alcohols derived from tallow and coconut oil; sodium coconut oil fatty acid monoglyceride sulfonates and sulfates.

A group of bleach stable anionic surfactants are the alkali metal paraffin sulfonates containing from about 8 to 22 carbon atoms in the paraffin chain. These are well-known commercially available surfactants which can be prepared, for example, by the reaction of olefins with sodium bisulfite. Examples are sodium-1-decane sulfonate, sodium-2-tridecane sulfonate and potassium-2-octadecane sulfonate. A related group of surfactants are those having the following formula:

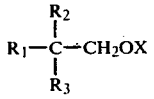

wherein $R_1$, $R_2$ and $R_3$, which can be the same or different, are alkyl groups of 1 to 18 carbon atoms, the sum of the carbon atoms of $R_1$, $R_2$ and $R_3$ being 10 to 20, and X is $-SO_3M$, $-CH_2COOM$, $-CH_2CH_2COOM$, $-(CH_2CH_2O)_nSO_3M$ or $-(CH_2CH_2O)_nCOOM$, wherein n is from 1 to 40 and M is an alkali metal (e.g., sodium or potassium). Such compounds are more fully described in U.S. Pat. No. 3,929,661, Nakagawe et al., issued December 30, 1975, and incorporated herein by reference.

Other synthetic anionic surfactants useful herein are alkyl ether sulfates. These materials have the formula $[RO(C_2H_4O)_xSO_3]_yM$ wherein R is an alkyl or alkenyl moiety having from about 8 to about 22 carbon atoms, x is 1 to 30, and M is a water-soluble cation, as defined hereinbefore, having a valency of y. The alkyl ether sulfates useful in the present invention are condensation products of ethylene oxide and monohydric alcohols having about 10 to about 20 carbon atoms. Preferably, R has 12 to 18 carbon atoms. The alcohols can be derived from fats, e.g., coconut oil or tallow, or can be synthetic. Lauryl alcohol and straight chain alcohols derived from tallow are preferred herein. Such alcohols are reacted with 1 to 30, and especially 3 to 6, molar proportions of ethylene oxide and the resulting mixture of molecular species, having, for example, an average of 3 to 6 moles of ethylene oxide per mole of alcohol, is sulfated and neutralized.

Specific examples of alkyl ether sulfates of the present invention are sodium coconut alkyl ethylene glycol ether sulfate; lithium tallow alkyl triethylene glycol ether sulfate; sodium tallow alkyl hexaoxyethylene sulfate; and sodium tallow alkyl trioxyethylene sulfate. The alkyl ether sulfates are known compounds and are described in U.S. Pat. No. 3,332,876 to Walker (July 25, 1967), hereby incorporated herein by reference.

Still other synthetic anionic surfactants are the alkali metal salts of alkyl phenol ethylene oxide ether sulfate with about four units of ethylene oxide per molecule and in which the alkyl radicals contain about 9 carbon atoms; the reaction product of fatty acids esterified with isethionic acid and neutralized with sodium hydroxide where, for example, the fatty acids are derived from coconut oil; sodium or potassium salts of fatty acid amides of a methyl taurine in which the fatty acids, for example, are derived from coconut oil; and others known in the art.

Generally then, a wide variety of preferred anionic surfactants are useful in the instant compositions as auxiliary suspension aids. Most preferred anionic surfactants include $C_8$ to $C_{16}$ alkyl benzene sulfonates, $C_{12}$ to $C_{18}$ alkyl sulfates, $C_{12}$ to $C_{18}$ ethoxylated alkyl sulfates having from 1 to 10 ethoxy moieties, and sodium paraffin sulfonates wherein the alkyl portion contains from 8 to 16 carbon atoms. For reasons of economics and environmental compatibility, sodium linear alkyl benzene sulfonates having from 11 to 12 carbon atoms ($C_{11.8}$ avg.) in the alkyl portion are most particularly preferred.

Partiularly preferred surfactants for use as auxiliary suspension aids are the fatty acid soaps and the alkali metal salts of linear alkyl benzene sulfonates with alkyl chain lengths of 8 to 22 carbon atoms, preferably having an average alkyl chain length of about 12 carbon atoms.

CATIONIC SURFACTANTS

Another class of auxiliary suspension aids which are useful herein are cationic surfactants.

Suitable cationic surfactants have the empirical formula:

$$R^1{}_mR^2{}_xY_LZ$$

wherein each $R^1$ is a hydrophobic organic alkyl or alkenyl group containing a total of from 6 to 22 carbon atoms and comprising straight or branched alkyl or alkenyl groups optionally substituted by up to three phenyl groups and optionally interrupted by phenyl linkages, ether linkages, ester or reverse ester linkages, amide or reverse amide linkages, and combinations thereof, and which may additionally contain or be attached to a polyethylene oxide chain containing up to about 20 ethyl groups. m is a number from one to three. $R^2$ is selected from an alkyl or hydroxyalkyl group containing from 1 to 6, preferably from 1 to 4 carbon atoms; a $C_1$ to $C_6$ alkyl benzyl or benzyl group (with no more than one $R^2$ in a molecule being benzyl or alkyl benzyl); or a polyethylene oxide chain containing up to about 20 ethoxy groups; and x is a number from 0 to 11, preferably from 0 to 3. The remainder of any carbon atom positions on the Y group are filled by hydrogens. Y is selected from the group consisting of:

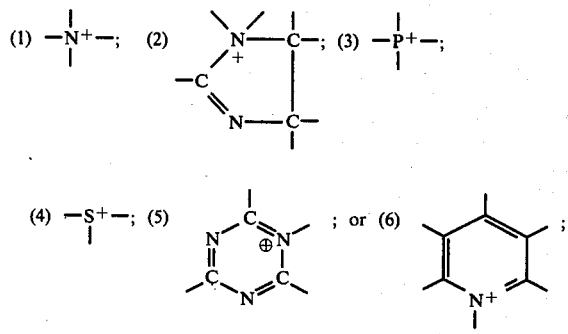

and mixtures thereof; L is a number from 1 to 4, preferably from 1 to 2. (In the event that $L_1$ is greater than one, each Y group is separated by an $R^1$ or $R^2$ analog linkage, preferably an alkylene or alkenylene linkage, having from one to about 22 carbon atoms.) Z is one or more water-soluble anions, such as halide, sulfate, methylsulfate, ethylsulfate, phosphate, hydroxide, fatty acid (laurate, myristate, palmitate, oleate, or stearate in particular) or nitrate anions, particularly preferred being chloride, bromide and iodide anions, in a sufficient number to balance the electronic charge of the cationic component. The particular cationic component to be included in a given system depends to a large extent upon the particular nonionic component to be used in this system, and is selected such that it is at least water-dispersible, or preferably water-soluble, when mixed with said nonionic surfactant in an ordinary washing liquor dilution. It is preferred that the cationic component be substantially free of hydrazinium groups. Mixtures of these cationic materials may also be used in the compositions of the present invention.

When used in combination with nonionic surfactants, these cationic surfactants provide excellent soil removal characteristics, confer static control and fabric softening benefits to the laundered fabrics, and inhibit the transfer of dyes among the laundered fabrics in the wash solution. Some of the mono- (long chain) compounds provided below also provide sanitization of the wash load. However, in the present invention cationic surfactants are primarily useful as suspension agents. Thus, the cationic surfactants described herein need not be limited to those which are useful for laundering fabrics.

In preferred cationic surfactants, L is equal to 1 and Y is

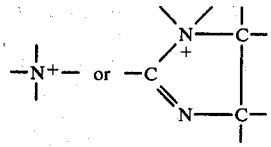

However, L may be greater than 1, such as in cationic components containing 2 to 3 cationic charge centers.

In the simplest quaternary ammonium cationic surfactants, L is 1 and Y is a quaternary nitrogen atom.

A first type of these simplest quaternary ammonium surfactants useful herein is that a mono- (long chain) quaternary ammonium surfactants. For these surfactants m is equal to one, x is preferably equal to three, and $R^1$, $R^2$ and Z are as previously defined. Two common categories of mono- (long chain) quaternary ammonium surfactants are the salts of $C_{10}$–$C_{20}$ alkyl trimethyl ammonium cations or $C_{10}$–$C_{15}$ alkylbenzyl trimethylammonium cations and any of the above anions, particularly halides. In particularly preferred embodiments of mono- (long chain) quaternary ammonium surfactants, the long chain alkyl moiety is derived from middle cut coconut alcohol having an average alkyl moiety chain length of about 12 to 14 carbon atoms, or from tallow fatty alcohol having an alkyl moiety chain length of 14 to 18 carbon atoms.

Another category of mono- (long chain) quaternary ammonium surfactants is that in which one $R^2$ moiety is a hydroxyethyl or hydroxypropyl moiety. Specific categories of these hydroxyalkyl substituted compounds are the compounds of $C_{10}$–$C_{16}$ alkyl dimethyl hydroxyethyl ammonium cations and laurate, palmitate, oleate, or stearate anions. Other hydroxyalkyl substituted compounds are compounds of $C_{10}$–$C_{16}$ alkyl dimethyl hydroxyethyl ammonium cations or $C_{10}$–$C_{16}$ alkyl dimethyl hydroxypropyl ammonium cations and any of the previously listed anions. A particularly preferred source of the mono- (long chain) moiety is again a middle cut of coconut alcohol having an alkyl chain length of about 12 to 14 carbon atoms.

Another category of mono- (long chain) quaternary ammonium surfactants useful herein is that in which two $R^2$ moieties are hydroxyalkyl groups. Representative surfactants of this type are $C_8$–$C_{16}$ alkyl dihydroxyethyl methyl ammonium cations, $C_8$–$C_{16}$ alkyl dihydroxyethyl benzyl ammonium cations, or $C_8$–$C_{16}$ alkyl dihydroxyethyl mono- ($C_2$–$C_4$ alkyl) ammonium cations, combined with any of the previously mentioned anions.

Another category or mono- (long chain) quaternary ammonium surfactants are those in which one or two $R^2$ moieties are linear chains of ethylene oxide, propylene oxide or butylene oxide moieties. These surfactants include $C_8$–$C_{18}$ alkyl di-$[(CH_2CH_2O)_nH]$ methyl ammonium cations, $C_8$–$C_{18}$ alkyl di-$[(CH_2CH_2O)_nH]$ benzyl ammonium cations, $C_8$–$C_{18}$ alkyl $[(CH_2CH_2O)_nH]$ methyl benzyl ammonium cations and any of the previously described anions. In these examples n is an integer between 2 and 20, preferably between 2 and 14, and more preferably between 2 and 8.

In a second type of these simplest quaternary ammonium surfactants useful herein, m is equal to two and x is preferably equal to two. These are known hereinafter as di- (long chain) quaternary ammonium surfactants. Preferred surfactants of this type are di- ($C_8$–$C_{20}$ alkyl) dimethyl ammonium cations, preferably di- ($C_{12}$–$C_{20}$) alkyl dimethyl ammonium cations, combined with any of the previously described anions. Specific compositions of this type are ditallow dimethyl ammonium chloride, ditallow dimethyl ammonium methylsulfate, dioctyl dimethyl ammonium halides, didecyl dimethyl ammonium halides, didodecyl dimethyl ammonium halides, dimyristyl dimethyl ammonium halides, dipalmityl dimethyl ammonium halides, distearyl dimethyl ammonium halides, the ester formed from two moles of stearic acid and one mole of triethanol methyl ammonium chloride, and so forth. The two long chains of such di- (long chain) compounds may also be unequal in length.

In another type of di- (long chain) quaternary ammonium surfactants, m is 2, x is 2, $R^1$ is as described above, and each $R^2$ is a polyethylene oxide chain separately selected from such chains containing up to about 20 ethoxy groups, preferably from 2 to 11 ethoxy groups, with the total number of ethoxy groups in the molecule not exceeding about 13.

In a third type of these simplest quaternary ammonium surfactants, known herein as tri- (long chain) quaternary ammonium surfactants, m is equal to three and x is equal to one in the preceding generic formula. In tri- (long chain) surfactants $R^2$ is preferably a methyl moiety, and each $R^1$ is preferably selected (independently) from the group of $C_8$–$C_{11}$ alkyl moieties. Specific tri- (long chain) quaternary ammonium surfactants include combinations of trioctyl methyl ammonium cations or tri-(decyl) methylammonium cations and a suitable anion such as halide.

Quaternary ammonium surfactants can be prepared by techniques well known to those skilled in the art and which do not form part of the present invention. However, a particularly preferred technique comprises the quaternization of a tertiary amine in a liquid polyethylene oxide condensate reaction medium which is itself a component of the present invention. The resultant mixture of a cationic surfactant and a polyethylene oxide condensate can be utilized directly in the invention without isolation of the cationic surfactant per se.

The technique involves dissolving or dispersing a normally nonvolatile tertiary amine, containing one or more long chain hydrocarbon residues, in a nonionic polyethoxylate condensate. A relatively volatile quaternizing agent having a boiling point less than 200° C., preferably less than 100° C., and most preferably less than ambient temperature, is reacted with this mixture to form the cationic surfactant. The mixture of cationic surfactant and ethoxylate is normally a dispersion which is solid at ambient temperatures and liquid at temperatures greater than approximately 45° C. but certain preferred hydroxyalkyl group-containing quaternary ammonium surfactants having a long chain carboxylate counter ion are miscible with polyethoxylated nonionic surfactants and form clear solutions.

Because of their waxy nature and their high affinity for conventional solvents these hydroxyalkyl group-containing quaternary ammonium surfactants are very difficult to prepare in the solvent-free solid state and the above-described technique is a convenient way to obtain them in a form suitable for the purposes of the present invention.

Another group of useful cationic compounds are the polyammonium salts, wherein L is greater than one and each Y is a quaternary nitrogen atom. Particular polyammonium salts of this type may have the formula:

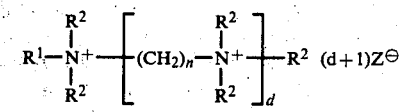

wherein $R^1$ and $R^2$ and Z are as defined above, n is from 1 to 6 and d is from 1 to 3. A specific example of a material in this group is one in which $R^1$ is a tallow alkyl moiety, $R^2$ is methyl, n is 3, d is one, and Z represents two methylsulfate anions.

Another useful type of cationic component has the formula:

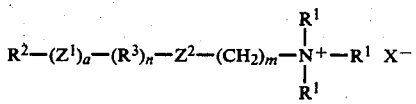

wherein $R^1$ is $C_1$–$C_4$ alkyl or hydroxyalkyl; $R^2$ is $C_5$–$C_{30}$ straight or branched chain alkyl, alkenyl, alkyl benzene or

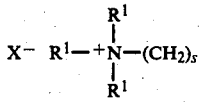

wherein x is from 0 to 5; $R^3$ is $C_1$–$C_{20}$ alkyl or alkenyl; a is 0 or 1; n is 0 or 1; m is from 1 to 5; $Z^1$ and $Z^2$ are each selected from the group consisting of

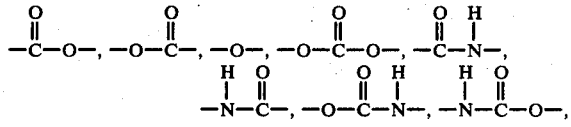

and wherein at least one of said groups is selected from the group consisting of ester, reverse ester, amide and reverse amide; and X is an anion which makes the compound at least water-dispersible, preferably selected from the group consisting of halide, methylsulfate, hydroxide, and nitrate, and more preferably selected from chloride, bromide and iodide.

In addition to the advantages of the other cationic surfactants disclosed herein, this particular cationic component is environmentally desirable, since it is biodegradable, both in terms of its long alkyl chain and its nitrogen-containing segment.

Preferred cationic surfactants of this type are the choline ester derivatives having the following formula:

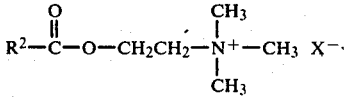

as well as those wherein the ester linkage in the above formula is replaced with a reverse ester, amide or reverse amide linkage.

Particularly preferred examples of this type of cationic surfactant include stearoyl choline ester quaternary ammonium halides ($R^2=C_{17}$ alkyl), palmitoyl choline ester quaternary ammonium halides ($R^2=C_{15}$ alkyl), myristoyl choline ester quaternary ammonium halides ($R^2=C_{13}$ alkyl), lauroyl choline ester ammonium halides ($R^2=C_{11}$ alkyl), caproyl choline ester quaternary ammonium halides ($R^2=C_9$ alkyl) capryloyl choline ester quaternary ammonium halides ($R^2=C_7$ alkyl), and tallowoyl choline ester quaternary ammoniun halides ($R^2=C_{15}$–$C_{17}$ alkyl).

Additional preferred cationic components of the choline ester variety are given by the structural formulas below, wherein p may be from 0 to 20.

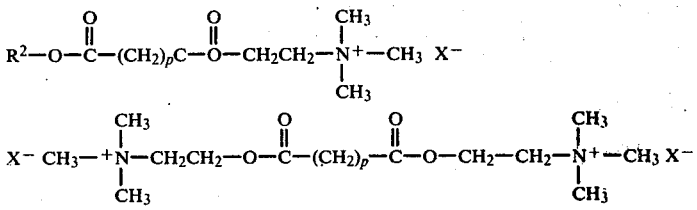

The preferred choline-derivative cationic surfactants, discussed above, may be prepared by the direct esterification of a fatty acid of the desired chain length with dimethylaminoethanol, in the presence of an acid catalyst. The reaction product is then quaternized with a methyl halide, forming the desired cationic surfactant. The choline-derived cationic surfactants may also be prepared by the direct esterification of a long chain fatty acid of the desired chain length together with 2-haloethanol, in the presence of an acid catalyst material. The reaction product is then used to quaternize triethanolamine, forming the desired cationic component.

Another type of novel, particularly preferred cationic surfactant is one having the formula:

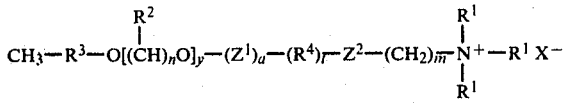

In the above formula, each $R^1$ is a $C_1$–$C_4$ alkyl or hydroxyalkyl group, preferably a methyl group. Each $R^2$ is either hydrogen or $C_1$–$C_3$ alkyl, preferably hydrogen. $R^3$ is a $C_4$–$C_{30}$ straight or branched chain alkyl, alkenylene, or alkyl benzyl group, preferably a $C_8$–$C_{18}$ alkyl group, most preferably a $C_{12}$ alkyl group. $R^4$ is a $C_1$–$C_{10}$ alkylene or alkenylene group. n is from 2 to 4, preferably 2; y is from 1 to 20, preferably from about 1 to 10, most preferably about 7; a may be 0 to 1; t may be 0 or 1; and m is from 1 to 5, preferably 2. $Z^1$ and $Z^2$ are each selected from the group consisting of

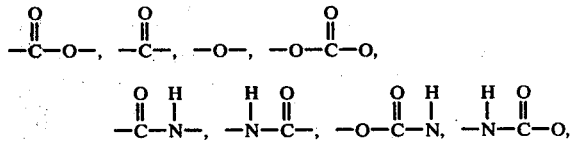

and wherein at least one of said groups is selected from the group consisting of ester, reverse ester, amide and reverse amide. X is an anion which will make the compound at least water-dispersible, and is selected from the group consisting of halides, methylsulfate, hydroxide and nitrate, particularly chloride, bromide and iodide.

Preferred embodiments of this type of cationic surfactant are the choline esters ($R^1$ is a methyl group and $Z^2$ is an ester or reverse ester group), particular formulas of which are given below. In these formulas t is 0 or 1, y is from 1 to 20 and $F^3$ is as defined above.

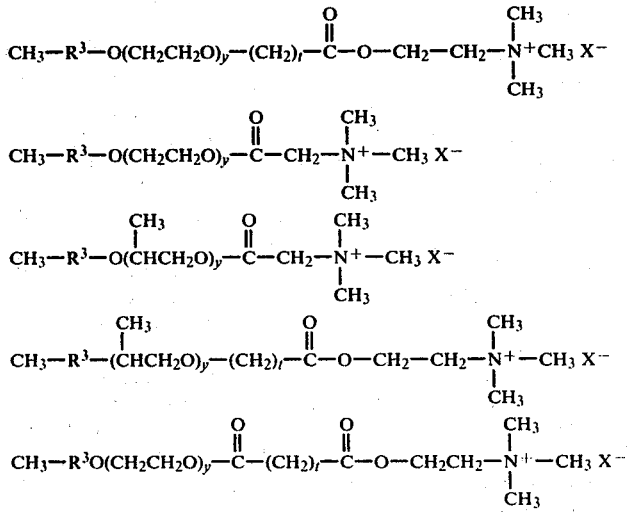

-continued

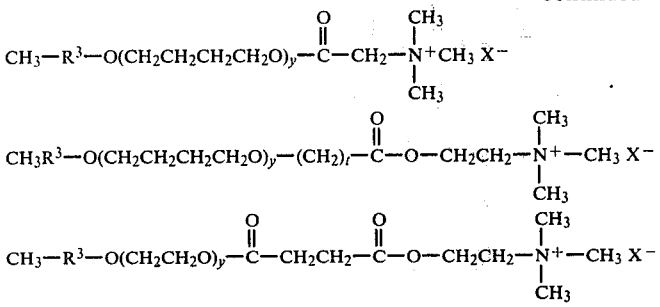

The preferred choline derivatives, described above, may be prepared by the reaction of a long chain alkyl polyalkoxy (preferably polyethoxy) carboxylate, having an alkyl chain of the desired length, with oxalyl chloride to form the corresponding acid chloride. The acid chloride is then reacted with dimethylaminoethanol to form the appropriate amine ester, which is then quaternized with a methyl halide to form the desired choline ester compound. Another way of preparing these compounds is by the direct esterification of the appropriate long chain ethoxylated carboxylic acid together with a 2-haloethanol or dimethyl aminoethanol, in the presence of heat and an acid catalyst. The reaction product formed is then quaternized with a methylhalide or used to quaternize trimethylamine to form the desired choline ester compound.

Another preferred type of cationic surfactant useful in the compositions of the present invention is of the imidazolinium variety. A particularly preferred surfactant of this type is one having the structural formula:

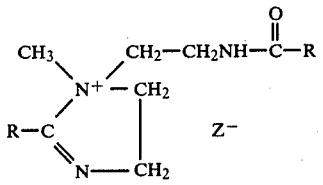

wherein R is $C_{10}$–$C_{20}$ alkyl, particularly $C_{14}$–$C_{20}$ alkyl. These imidazolinium surfactants may be used alone as the cationic component in the compositions of the present invention, or may be used in mixtures, together with other cationic surfactants, such as those described above. Particularly preferred mixtures of this type include the imidazolinium surfactant, shown above, together with palmitylalkyl trimethylammonium chloride or coconutalkyl trimethylammonium chloride or a mixture of coconutalkyl trimethylammonium chloride and palmitylalkyl trimethylammonium chloride.

The cationic surfactant can be incorporated into the additive products of the invention in various ways well known to those skilled in the art. A preferred technique of addition of cationic surfactants to nonionic surfactants, as previously mentioned, is one in which the cationic surfactant is formed in situ in a nonionic surfactant which is used as the reaction medium for the quaternization of a suitable tertiary amine. This technique provides a uniform dispersion of the cationic surfactant and also avoids the use of volatile solvents or water (commonly found in commercially available quaternary ammonium surfactants) which may require removal before the cationic surfactant can be used in products of the present invention.

ZWITTERIONIC SURFACTANTS

Another class of surfactants useful herein as auxiliary suspension aids are the zwitterionic surfactants. Zwitterionic surface active agents operable in the instant composition are broadly described as internally-neutralized derivatives of aliphatic quaternary ammonium, phosphonium and tertiary sulfonium compounds, in which the aliphatic radical can be straight chain or branched, and wherein one of the aliphatic substituents contains from about 8 to 18 carbon atoms and one contains an anionic water-solubilizing group, e.g., carboxy, sulfo, sulfato, phosphato or phosphono. Some of these zwitterionic surfactants are described in the following U.S. Pat. Nos.: 2,129,264; 2,178,353; 2,774,786; 2,813,898; 2,828,332; 3,925,262; and 3,929,678; all of which are hereby incorporated herein by reference. The ammoniopropane sulfonates containing about 8 to 21 carbon atoms are one class of surfactant compounds preferred herein by virtue of their relatively low calcium ion (hardness) sensitivity.

The preferred zwitterionic surfactants are those having one of the formulas:

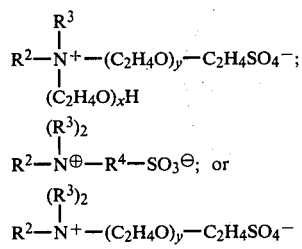

(1)

(2)

(3)

wherein $R^2$ contains from about 8 to about 16 carbon atoms and has an average of from about 10 to about 13 carbon atoms, each $R^3$ is separately selected from the group consisting of alkyl and hydroxy alkyl groups containing from 1 to about 3 carbon atoms, x is from about 5 to about 10, preferably from about 8 to about 9, y is the difference between x and about 15, and $R^4$ is a saturated alkylene or hydroxyalkylene group containing from 2 to about 5 carbon atoms and wherein the hydroxy group in said hydroxyalkylene group is attached to a carbon atom which is separated from the nitrogen atom by at least one methylene group.

Preferred examples of the material of formula (1) above are ones in which $R^2$ is a ($C_{16}H_{33}$) moiety, $R^3$ is methyl, and the sum of x and y is 15. A preferred example of the material of formula (2) above is one in which $R^2$ is a dodecyl ($C_{12}H_{25}$) moiety, $R^3$ is a methyl group, and $R^4$ is —$CH_2CH_2O$—. A preferred example of the material of formula (3) above is one in which y is from 8 to 9, each $R^3$ is a methyl group and $R^2$ is a palmityl ($C_{16}H_{33}$) moiety.

The water-soluble betaine surfactants are another example of a zwitterionic surfactant useful herein. These materials have the general formula:

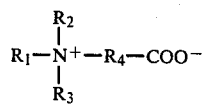

wherein $R_1$ is an alkyl group containing from about 8 to 18 carbon atoms; $R_2$ and $R_3$ are each lower alkyl groups containing from about 1 to 4 carbon atoms, and $R_4$ is an alkylene group selected from the group consisting of methylene, propylene, butylene and pentylene. (Propionate betaines decompose in aqueous solution and are hence not preferred for optional inclusion in the instant compositions.)

Examples of suitable betaine compounds of this type include dodecyldimethylammonium acetate, tetradecyldimethylammonium acetate, hexadecyldimethylammonium acetate, alkyldimethylammonium acetate wherein the alkyl group averages about 14.8 carbon atoms in length, dodecyldimethylammonium butanoate, tetradecyldimethylammonium butanoate, hexadecyldimethylammonium butanoate, dodecyldimethylammonium hexanoate, hexadecyldimethylammonium hexanoate, tetradecyldimethylammonium pentanoate and tetradecyldipropyl ammonium pentanoate. Especially preferred betaine surfactants include dodecyldimethylammonium acetate, dodecyldimethylammonium hexanoate, dexadecyldimethylammonium acetate, and hexadecyldimethylammonium hexanoate.

HYDROTROPIC MATERIALS

A final category of auxiliary suspension aids which are useful in the present invention are any of the materials known to the art as hydrotropes. It will be noted, however, that these materials do not function as hydrotropes in the compositions of the present invention, for they are not used herein to solubilize an ordinarily water-insoluble component in an aqueous solution. In the context of the present invention, hydrotropic materials can be used to increase the stability of liquid mulls.

The hydrotropic materials useful herein include the alkali metal (especially sodium or potassium), ammonium, and mono-, di- and triethanolamine salts of acids selected from benzene sulfonic acids, $C_1$–$C_7$ linear alkyl benzene sulfonic acids, xylene sulfonic acids and $C_6$–$C_7$ alkyl sulfonic acids. Also useful as hydrotropic materials herein are the $C_6$–$C_7$ alkyl sulfates.

Examples of specific hydrotropic materials useful herein are as follows: sodium benzene sulfonate; alkali metal toluene sulfonates such as potassium paratoluene sulfonate; potassium ortho-, meta- or para-xylene sulfonates; ammonium para-ethyl benzene sulfonates; potassium para-isopropylbenzene sulfonates; triethanolamine para-benzene sulfonates; sodium-n-heptylsulfonate; and sodium-n-hexylsulfonate.

WATER

The liquid mull of the present invention may contain water. The preferred compositions contain from 0% to 10% water, more preferably from 0% to 5% water, and most preferably no water in compositions which contain enzymes, bleaches or other water-sensitive materials. It has been found that in some cases a small quantity of water does increase the stability of the compositions, although this is not true for a larger proportion of water than is called for in the present specification. Thus, water does not appear to function primarily as a solvent in the present compositions.

OPTIONAL INGREDIENTS

Although the mulls made from the ingredients described above are effective detergent compositions, particularly for use as laundry detergents, there are many optional ingredients which may be included in such compositions besides those major ingredients listed specifically above. These ingredients may be incorporated in the compositions as part of the liquid phase or as part of the dispersed solid phase thereof.

The compositions of the present invention may also contain additional ingredients generally found in laundry detergent compositions, at their conventional art-established levels.

The compositions of the present invention may contain up to about 15%, preferably up to about 5%, and most preferably from about 0.1% to 2%, of a suds suppressor component. Typical suds suppressors include long chain fatty acids, such as those described in U.S. Pat. No. 2,954,347 issued to St. John et al. on Sept. 27, 1960, and combinations of certain nonionics therewith, as disclosed in U.S. Pat. No. 2,954,348 issued to Schwoeppe on Sept. 27, 1960, both disclosures being incorporated herein by reference. Other suds suppressor components useful in the compositions of the present invention include, but are not limited to, those described below.

Preferred silicone suds suppressing additives are described in U.S. Pat. No. 3,933,672 issued to Bartolotta et al. on Jan. 20, 1976, incorporated herein by reference. The silicone material can be represented by alkylated polysiloxane materials such as silica aerogels and xerogels and hydrophobic silicas of various types. The silicone material can be described as a siloxane having the formula:

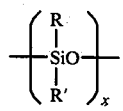

wherein x is from about 20 to about 2,000, and R and R′ are each alkyl or aryl groups, especially methyl, ethyl, propyl, butyl and phenyl. The polydimethylsiloxanes (R and R′ are methyl) having a molecular weight within the range of from about 200 to about 200,000, and higher, are all useful as suds controlling agents. Additional suitable silicone materials wherein the side chain groups R and R′ are alkyl, aryl, or mixed alkyl and aryl hydrocarbyl groups exhibit useful suds controlling properties. Examples of the latter ingredients include diethyl-, dipropyl-, dibutyl-, methyl-, ethyl-, and phenylmethyl-polysiloxanes and the like. Additional useful silicone suds controlling agents can be represented by a mixture of an alkylated siloxane, as referred to hereinbefore, and solid silica. Such mixtures are prepared by affixing the silicone to the surface of the solid silica. A preferred silicone suds controlling agent is represented by a hydrophobic silanated (most preferably trimethylsilanated) silica, having a particle size in the range from about 10 millimicrons to 20 millimicrons and a specific surface area above about 50 $m^2$/gm., intimately admixed with dimethyl silicone fluid, having a molecular weight in the range from about 500 to about 200,000, at a weight ratio of silicone to silanated silica of from about 19:1 to about 1:2. The silicone suds suppressing agent is advantageously releasably incorporated in a water-soluble or water-dispersible, substantially nonsurface-active detergent-impermeable carrier.

Particularly useful suds suppressors are the self-emulsifying silicone suds suppressors, described in U.S. Pat. No. 4,136,045 issued to Gault et al on Jan. 23, 1979, incorporated herein by reference. An example of such a compound is DB-544, commercially available from Dow Corning, which contains a siloxane/glycol copolymer together with solid silica and a siloxane resin.

Microcrystalline waxes having a melting point in the range from 35° C.–115° C. and a saponification value of less than 100 represent additional examples of a preferred suds regulating component for use in the subject compositions, and are described in detail in U.S. Pat. No. 4,056,481 issued to Tate on Nov. 1, 1977, incorporated herein by reference. The microcrystalline waxes are substantially water-insoluble, but are water-dispersible in the presence of organic surfactants. Preferred microcrystalline waxes have a melting point from about 65° C. to 100° C., a molecular weight in the range from 400–1,000; and a penetration value of at least 6, measured at 77° F. by ASTM-D1321. Suitable examples of the above waxes include: microcrystalline and oxidized microcrystalline petrolatum waxes; Fischer-Tropsch and oxidized Fischer-Tropsch waxes; ozokerite; ceresin; montan wax; beeswax; candelilla; and carnauba wax.

Alkyl phosphate esters represent an additional preferred suds suppressant for use herein. These preferred phosphate esters are predominantly monostearyl phosphate which, in addition thereto, can contain di- and tristearyl phosphates; and monooleyl phosphates, which can contain di- and trioleyl phosphates.

The alkyl phosphate esters frequently contain some trialkyl phosphate. Accordingly, a preferred phosphate ester can contain, in addition to the monoalkyl ester, e.g., monostearyl phosphate, up to 50 mole percent of dialkyl phosphate and up to about 5 mole percent of trialkyl phosphate.

Soil suspending agents at about 0.1% to 10% by weight such as water-soluble salts of carboxymethylcellulose, carboxyhydroxymethyl cellulose, and polyethylene glycols having a molecular weight of about 400 to 10,000 are optional components of the present invention. Pigments, dyes such as bluing and perfumes can be added in varying amounts if desired.

Other materials such as brightening agents may also be used herein. Anionic fluorescent brightening agents are well known materials, examples of which are disodium 4,4'-bis-(2-diethanolamino-4-anilino-s-triazin-6-ylamino)stilbene-2:2'-disulphonate, disodium 4,4'-bis-(2-morpholino-4-anilino-s-triazin-6-ylamino)stilbene-2:2'-disulphonate, disodium 4,4'-bis-(2,4-dianilino-s-triazin-6-ylamino)stilbene-2:2'-disulphonate, disodium 4,4'-bis-(2-anilino-4-(N-methyl-N-2-hydroxyethylamino)-s-triazin-6-ylamino)stilbene-2,2'-disulphonate, disodium 4,4'-bis-(4-phenyl-2,1,3-triazol-2-yl)-stilbene-2,2'disulphonate, disodium 4,4'-bis(2-anilino-4-(1-methyl-2-hydroxyethylamino)-s-triazin-6-ylamino)stilbene-2,2'disulphonate and sodium 2(stilbyl-4''-(naphtho-1',2':4,5)-1,2,3-triazole-2''-sulphonate.

MAKING THE MULL

The mulls of the present invention are made under high shear mixing conditions. These conditions may be provided by using any of the high-shear stirring apparatus available to the art. The mull may be made as follows, although the order of addition of ingredients is not critical in order to produce acceptable compositions.

First, the ingredients which are to form the liquid phase are placed in the mixer and the impeller is started. Next, the materials forming the solid phase of the mull, including the chain structure type clay, are mixed with the liquid phase. Finally, any optional ingredients which have not already been added are then mixed into the composition. The high shear mixing process is continued until the chain structure type clay is sufficiently dispersed throughout the composition to provide the structure and viscosity (at rest) which is necessary in order to produce a stable suspension. A long mixing time will result in a product having increased viscosity, thus providing a less mobile but more stable product. A shorter mixing time will have the opposite effect. Thus, the appropriate mixing time will vary in a given application. As a general rule, the composition should be mixed no longer than is necessary to provide the necessary degree of stability with respect to settling, if a product of the lowest attainable viscosity is desired.

Preferred liquid mulls herein are those which are either pourable or pumpable.

EXAMPLES

In the following examples liquid mull compositions were made in batches of about 600 grams as follows:

First, the components were premixed in a 1 liter laboratory beaker. The nonionic surfactant was placed in the beaker first, followed by addition of the other ingredients in the order in which they are listed in the tables below. Premixing was accomplished with a Model V-7 Lightning Mixer, sold by Mixing Equipment Co., Inc., consisting of a single revolving shaft which carried two 5 centimeter diameter marine propellers mounted 5 centimeters apart on the shaft. The shaft speed was roughly 500 rpm.

Next, the mixture of ingredients was transferred to a high shear mixer in order to increase the dispersion of the clay particles. The mixer used was a Gifford-Wood homogenizing mixer, Model No. 1L, available from J. W. Greer, Incorporated. The mixer line voltage was reduced to about 70 volts (60 Hz. A.C.) using a variable voltage transformer. The mixer was run for two minutes, after which the composition was complete.

To test the stability of the compositions, each was poured into two 4 ounce jars, each jar having a diameter of about 5 centimeters, so that the two samples each had a depth of 6 centimeters. The jars were then sealed and stored at rest. One jar in each pair was stored at a temperature of 70° F. (21° C.), and the other jar was stored at a temperature of 120° F. (49° C.). Stability was measured at several elapsed times by measuring the depth of a clear liquid layer which formed in many of the jars, using a graduated rule held against the outside of each jar. If no clear liquid layer formed, this indicated a high degree of stability. Where no clear layer was present, a depth of "0.0 cm." was reported.

Table I shows the effects of various clays (or absence thereof) on suspension stability of liquid compositions. In the table Imvite IGS and Attagel 50 are commercial grades of chain structure clays as identified above. Hydrite PX is a clay in which kaolinite clay predominates, and is commercially available from Georgia Kaolin Company. Veegum T is a predominantly hectorite commercial grade clay available from Vanderbilt Company, Inc. Bentolite L is a commercial grade of montmorillonite clay available from Georgia Kaolin Company. MAXAZYME is a commercial enzyme preparation as identified above; LAS is an alkyl benzene sulfonate anionic surfactant, 90% purity, with an average alkyl chain length of 11.8 carbon atoms. TSPP is an abbreviation for tetrasodium pyrophosphate, the primary suspended solid matter. Unless otherwise noted, the TSPP used in all the compositions herein had a specific gravity of 2.5 grams per cc and an average particle size of 27 microns. Neodol 23-5 is a commercial nonionic surfactant as identified above.

TABLE I

| | Parts | | | |
|---|---|---|---|---|
| Ingredient | A | B | C | D |
| Neodol 23-5 | 49.5 | 49.5 | 49.5 | 49.5 |
| MAXAZYME | 2.0 | 2.0 | 2.0 | 2.0 |
| Propylene Glycol | 2.0 | 2.0 | 2.0 | 2.0 |
| Brightener | 0.5 | 0.5 | 0.5 | 0.5 |
| TSPP | 37.0 | 37.0 | 37.0 | 37.0 |
| LAS | 5.0 | 5.0 | 5.0 | 5.0 |
| Imvite IGS | — | 3.0 | — | — |
| Attagel 50 | — | — | 3.0 | — |
| Hydrite PX | — | — | — | 3.0 |
| Veegum T | — | — | — | — |
| Bentolite L | — | — | — | — |
| Stability Data | Depth of Liquid Surface Layer | | | |
| 1 Day 70° F. | 0.3 cm | 0.0 cm | 0.0 cm | 0.2 cm |
| 1 Week 70° F. | 1.7 cm | 0.1 cm | 0.0 cm | 0.9 cm |
| 2 Weeks 70° F. | 2.0 cm | 0.1 cm | 0.0 cm | 1.4 cm |
| 4 Weeks 70° F. | 2.0 cm | 0.5 cm | 0.0 cm | 1.6 cm |
| 8 Weeks 70° F. | 2.4 cm | 0.7 cm | 0.0 cm | 2.0 cm |
| 12 Weeks 70° F. | 2.6 cm | 1.0 cm | 0.0 cm | 2.3 cm |
| 1 Day 120° F. | 1.4 cm | 0.0 cm | 0.0 cm | 0.8 cm |
| 1 Week 120° F. | 2.1 cm | 0.4 cm | 0.1 cm | 2.0 cm |
| 2 Weeks 120° F. | 2.6 cm | 0.9 cm | 0.1 cm | 2.5 cm |
| 4 Weeks 120° F. | 2.8 cm | 1.2 cm | 0.2 cm | 2.6 cm |
| 8 Weeks 120° F. | 2.9 cm | 1.5 cm | 0.4 cm | 2.7 cm |
| 12 Weeks 120° F. | 3.0 cm | 1.8 cm | 0.9 cm | 3.2 cm |

| | Parts | | | |
|---|---|---|---|---|
| Ingredient | E | F | G | H |
| Neodol 23-5 | 49.5 | 49.5 | 49.5 | 49.5 |
| MAXAZYME | 2.0 | 2.0 | 2.0 | 2.0 |
| Propylene Glycol | 2.0 | 2.0 | 2.0 | 2.0 |
| Brightener | 0.5 | 0.5 | 0.5 | 0.5 |
| TSPP | 37.0 | 37.0 | 37.0 | 37.0 |
| LAS | 5.0 | 5.0 | 5.0 | 5.0 |
| Imvite IGS | — | — | 6.0 | — |
| Attagel 50 | — | — | — | 6.0 |
| Hydrite PX | — | — | — | — |
| Veegum T | 3.0 | — | — | — |
| Bentolite L | — | 3.0 | — | — |
| Stability Data | Depth of Liquid Surface Layer | | | |
| 1 Day 70° F. | 0.2 cm | 0.2 cm | 0.0 cm | 0.0 cm |
| 1 Week 70° F. | 1.2 cm | 1.4 cm | 0.0 cm | 0.0 cm |
| 2 Weeks 70° F. | 1.5 cm | 1.7 cm | 0.0 cm | 0.0 cm |
| 4 Weeks 70° F. | 1.7 cm | 2.0 cm | 0.0 cm | 0.0 cm |
| 8 Weeks 70° F. | 1.9 cm | 2.1 cm | 0.0 cm | 0.0 cm |
| 12 Weeks 70° F. | 2.1 cm | 2.5 cm | 0.0 cm | 0.0 cm |
| 1 Day 120° F. | 1.0 cm | 0.8 cm | 0.0 cm | 0.0 cm |
| 1 Week 120° F. | 1.7 cm | 1.6 cm | 0.0 cm | 0.0 cm |
| 2 Weeks 120° F. | 2.2 cm | 2.0 cm | 0.1 cm | 0.1 cm |
| 4 Weeks 120° F. | 2.5 cm | 2.0 cm | 0.2 cm | 0.2 cm |
| 8 Weeks 120° F. | 2.7 cm | 2.2 cm | 0.2 cm | 0.2 cm |
| 12 Weeks 120° F. | 2.7 cm | 2.5 cm | 0.6 cm | 0.5 cm |

TABLE I-continued

| | Parts | | |
|---|---|---|---|
| Ingredient | I | J | K |
| Neodol 23-5 | 49.5 | 49.5 | 49.5 |
| MAXAZYME | 2.0 | 2.0 | 2.0 |
| Propylene Glycol | 2.0 | 2.0 | 2.0 |
| Brightener | 0.5 | 0.5 | 0.5 |
| TSPP | 37.0 | 37.0 | 37.0 |
| LAS | 5.0 | 5.0 | 5.0 |
| Imvite IGS | — | — | — |
| Attagel 50 | — | — | — |
| Hydrite PX | 6.0 | — | — |
| Veegum T | — | 6.0 | — |
| Bentolite L | — | — | 6.0 |
| Stability Data | Depth of Liquid Surface Layer | | |
| 1 Day 70° F. | 0.1 cm | 0.1 cm | 0.1 cm |
| 1 Week 70° F. | 0.5 cm | 0.6 cm | 0.9 cm |
| 2 Weeks 70° F. | 0.9 cm | 1.0 cm | 1.4 cm |
| 4 Weeks 70° F. | 1.3 cm | 1.1 cm | 1.3 cm |
| 8 Weeks 70° F. | 1.6 cm | 1.3 cm | 1.8 cm |
| 12 Weeks 70° F. | 2.0 cm | 1.6 cm | 2.0 cm |
| 1 Day 120° F. | 0.3 cm | 0.3 cm | 0.4 cm |
| 1 Week 120° F. | 1.6 cm | 1.2 cm | 1.7 cm |
| 2 Weeks 120° F. | 2.0 cm | 1.7 cm | 2.2 cm |
| 4 Weeks 120° F. | 2.2 cm | 1.9 cm | 2.4 cm |
| 8 Weeks 120° F. | 2.3 cm | 2.0 cm | 2.4 cm |
| 12 Weeks 120° F. | 2.6 cm | 2.8 cm | 2.9 cm |

The data of Table I illustrates that chain structure type clays are better suspending agents than other clays. Composition A contained no clay and was very unstable. Compositions B and C each contained 3% of a chain structure type clay, and were more stable than Compositions D, E and F which each contained 3% of a clay not within the present invention. Similarly, a comparison of compositions G and H (containing clays within the present invention) with Samples I, J and K (containing clays not within the present invention) shows that chain structure type clays are much better suspending agents than are other clays.

Table II below demonstrates the stability of two suspensions which employ a chain structure type clay as the only suspension aid.

TABLE II

| | Parts | |
|---|---|---|
| Ingredient | A | B |
| Neodol 23-5 | 54.0 | 52.0 |
| MAXAZYME | 2.0 | 2.0 |
| Brightener | 1.0 | 1.0 |
| Imvite IGS | 6.0 | 8.0 |
| TSPP | 37.0 | 37.0 |
| Stability Data | Depth of Liquid Surface Layer | |
| 1 Day 70° F. | 0.0 cm | 0.0 cm |
| 1 Week 70° F. | 0.2 cm | 0.2 cm |
| 2 Weeks 70° F. | 0.3 cm | 0.4 cm |
| 1 Day 120° F. | 0.0 cm | 0.0 cm |
| 1 Week 120° F. | 0.4 cm | 0.3 cm |
| 2 Weeks 120° F. | 0.6 cm | 0.4 cm |

Comparison of Composition A in Table II with Samples I, J and K in Table I illustrates a composition containing 6% of a chain structure type clay but no LAS (an auxiliary suspension aid) was more stable than compositions containing both 6% of another clay and 5% LAS.

Table III below demonstrates the use of the present invention with a variety of nonionic surfactants as the liquid vehicle.

TABLE III

| | Parts | | |
|---|---|---|---|
| Ingredient | A | B | C |
| Neodol 23-5 | 49.5 | — | — |

TABLE III-continued

| | | | |
|---|---|---|---|
| Tergitol 15-S-5 | — | 49.5 | — |
| Sulfonic N-95 | — | — | 49.5 |
| TSPP | 37.0 | 37.0 | 37.0 |
| MAXAZYME | 2.0 | 2.0 | 2.0 |
| Propylene Glycol | 2.0 | 2.0 | 2.0 |
| LAS | 5.0 | 5.0 | 5.0 |
| Brightener | 0.5 | 0.5 | 0.5 |
| Imvite IGS | 4.0 | 4.0 | 4.0 |
| Stability Data | Depth of Liquid Surface Layer | | |
| 1 Day 70° F. | 0.0 cm | 0.0 cm | 0.0 cm |
| 1 Week 70° F. | 0.0 cm | 0.1 cm | 0.0 cm |
| 2 Weeks 70° F. | 0.1 cm | 0.2 cm | 0.0 cm |
| 4 Weeks 70° F. | 0.2 cm | 0.5 cm | 0.0 cm |
| 8 Weeks 70° F. | 0.6 cm | 0.6 cm | 0.1 cm |
| 12 Weeks 70° F. | 0.7 cm | 0.9 cm | 0.2 cm |
| 1 Day 120° F. | 0.0 cm | 0.0 cm | 0.0 cm |
| 1 Week 120° F. | 0.2 cm | 0.5 cm | 0.0 cm |
| 2 Weeks 120° F. | 0.5 cm | 0.8 cm | 0.1 cm |
| 4 Weeks 120° F. | 0.8 cm | 1.2 cm | 0.5 cm |
| 8 Weeks 120° F. | 0.9 cm | 1.3 cm | 0.7 cm |
| 12 Weeks 120° F. | 1.2 cm | 1.6 cm | 1.1 cm |

Table IV below shows that the average diameter of the particles of the dispersed solid phase (primarily tetrasodium pyrophosphate, abbreviated "TSPP") unexpectedly can be very large (at least 300 microns) without reducing the stability of the mull. In Table IV, the compositions are identical except for the particle size of TSPP.

TABLE IV

| Ingredient | Parts | | | | |
|---|---|---|---|---|---|
| Neodol 23-5 | 49.5 | | | | |
| MAXAZYME | 2.0 | | | | |
| Propylene Glycol | 2.0 | | | | |
| LAS | 5.0 | | | | |
| Brightener | 0.5 | | | | |
| Imvite IGS | 4.0 | | | | |
| TSPP | 37.0 | | | | |
| | A | B | C | D | E |
| Avg. Particle Size of TSPP (microns) | 4 | 20 | 27 | 70 | 300 |
| Stability Data | Depth of Liquid Surface Layer | | | | |
| 1 Day 70° F. | 0.0 cm | 0.0 cm | 0.0 cm | 0.0 cm | 0.0 cm |
| 1 Week 70° F. | 0.0 cm | 0.0 cm | 0.0 cm | 0.0 cm | 0.0 cm |
| 2 Weeks 70° F. | 0.2 cm | 0.1 cm | 0.1 cm | 0.0 cm | 0.0 cm |
| 4 Weeks 70° F. | 0.3 cm | 0.1 cm | 0.2 cm | 0.1 cm | 0.2 cm |
| 8 Weeks 70° F. | 0.4 cm | 0.3 cm | 0.6 cm | 0.4 cm | 0.3 cm |
| 12 Weeks 70° F. | 0.9 cm | 0.3 cm | 0.8 cm | 0.7 cm | 0.3 cm |
| 1 Day 120° F. | 0.0 cm | 0.0 cm | 0.0 cm | 0.0 cm | 0.0 cm |
| 1 Week 120° F. | 0.2 cm | 0.1 cm | 0.3 cm | 0.2 cm | 0.1 cm |
| 2 Weeks 120° F. | 0.4 cm | 0.2 cm | 0.5 cm | 0.3 cm | 0.1 cm |
| 4 Weeks 120° F. | 0.8 cm | 0.4 cm | 0.8 cm | 0.7 cm | 0.4 cm |
| 8 Weeks 120° F. | 1.0 cm | 0.5 cm | 1.1 cm | 0.9 cm | 0.5 cm |
| 12 Weeks 120° F. | 1.3 cm | 0.8 cm | 1.6 cm | 1.4 cm | 1.2 cm |

Table V below describes the use of a variety of different particulate materials as the dispersed particulate material of the mulls of the present invention. In Table V, TSPP is tetrasodium pyrophosphate (specific gravity 2.5 grams per cc, average particle size 27 microns), $Na_2SiO_3$ is sodium metasilicate (specific gravity 2.4 grams per cc, average particle size 300 microns), $Na_2CO_3$ is sodium carbonate (specific gravity 2.5 grams per cc, average particle size 250 microns) and NTA is nitrilotriacetic acid (specific gravity 2.4 grams per cc, average particle size 100 microns).

TABLE V

| Ingredient | Parts | | | |
|---|---|---|---|---|
| Neodol 23-5 | 49.5 | | | |
| MAXAZYME | 2.0 | | | |
| Propylene Glycol | 2.0 | | | |
| LAS | 5.0 | | | |
| Brightener | 0.5 | | | |
| Imvite IGS | 4.0 | | | |
| Solids | 37.0 | | | |
| | A | B | C | D |
| Type of Solid | TSPP | $Na_2SiO_3$ | $Na_2CO_3$ | NTA |
| Stability Data | Depth of Liquid Surface Layer | | | |
| 1 Day 70° F. | 0.0 cm | 0.0 cm | 0.0 cm | 0.0 cm |
| 1 Week 70° F. | 0.0 cm | 0.0 cm | 0.0 cm | 0.0 cm |
| 2 Weeks 70° F. | 0.1 cm | 0.0 cm | 0.0 cm | 0.0 cm |
| 4 Weeks 70° F. | 0.1 cm | 0.0 cm | 0.0 cm | 0.1 cm |
| 8 Weeks 70° F. | 0.3 cm | 0.0 cm | 0.0 cm | 0.1 cm |
| 12 Weeks 70° F. | 0.3 cm | 0.0 cm | 0.0 cm | 0.2 cm |
| 1 Day 120° F. | 0.0 cm | 0.0 cm | 0.0 cm | 0.0 cm |
| 1 Week 120° F. | 0.1 cm | 0.1 cm | 0.0 cm | 0.0 cm |
| 2 Weeks 120° F. | 0.2 cm | 0.2 cm | 0.0 cm | 0.1 cm |
| 4 Weeks 120° F. | 0.4 cm | 0.3 cm | 0.0 cm | 0.3 cm |
| 8 Weeks 120° F. | 0.5 cm | 0.3 cm | 0.0 cm | 0.6 cm |
| 12 Weeks 120° F. | 0.8 cm | 0.9 cm | 0.0 cm | 1.0 cm |

Table VI below shows the effect of various proportions of an anionic surfactant on the stability of the compositions. The anionic surfactant used was an alkyl benzene sulfonate having an average alkyl chain length of 11.8 carbon atoms, abbreviated thus: LAS.

TABLE VI

| | Parts | | | |
|---|---|---|---|---|
| Ingredient | A | B | C | D |
| Neodol 23-5 | 49.5 | 49.5 | 49.5 | 49.5 |
| MAXAZYME | 2.0 | 2.0 | 2.0 | 2.0 |
| Propylene Glycol | 2.0 | 2.0 | 2.0 | 2.0 |
| TSPP | 37.0 | 37.0 | 37.0 | 37.0 |
| Brightener | 0.5 | 0.5 | 0.5 | 0.5 |
| LAS | — | 2.0 | 5.0 | 10.0 |
| Imvite IGS | 3.0 | 3.0 | 3.0 | 3.0 |
| Stability Data | Depth of Liquid Surface Layer | | | |
| 1 Day 70° F. | 0.1 cm | 0.1 cm | 0.0 cm | 0.0 cm |
| 1 Week 70° F. | 1.0 cm | 0.6 cm | 0.2 cm | 0.0 cm |
| 2 Weeks 70° F. | 1.4 cm | 1.1 cm | 0.5 cm | 0.1 cm |
| 4 Weeks 70° F. | 1.8 cm | 1.5 cm | 0.9 cm | 0.6 cm |
| 8 Weeks 70° F. | 1.8 cm | 1.8 cm | 1.1 cm | 1.0 cm |
| 12 Weeks 70° F. | 2.0 cm | 2.0 cm | 1.3 cm | 1.3 cm |
| 1 Day 120° F. | 0.5 cm | 0.3 cm | 0.1 cm | 0.0 cm |
| 1 Week 120° F. | 1.4 cm | 1.4 cm | 0.9 cm | 0.6 cm |
| 2 Weeks 120° F. | 1.7 cm | 1.8 cm | 1.1 cm | 0.9 cm |
| 4 Weeks 120° F. | 2.0 cm | 1.8 cm | 1.4 cm | 1.2 cm |
| 8 Weeks 120° F. | 2.0 cm | 2.0 cm | 1.6 cm | 1.5 cm |
| 12 Weeks 120° F. | 2.1 cm | 2.0 cm | 1.6 cm | 1.6 cm |

The stability of Composition C of Table VI may be compared with the stability of Composition B in Table I to show the degree to which these results are reproducible. The data of Table VI shows that LAS improves the stability of the present compositions somewhat. However, comparison of Composition A of Table I with Composition A of Table VI, in which the 5% LAS of the former composition is replaced with 3% of a chain structure type clay, shows that a chain structure type clay is a better suspending agent than is LAS.

Table VII below shows the effect of potassium toluene sulfonate (KTS) on the suspension stability. KTS is shown to be useful as an auxiliary suspension aid.

TABLE VII

| Ingredient | Parts A | B | C |
|---|---|---|---|
| Neodol 23-5 | 49.5 | 49.5 | 49.5 |
| MAXAZYME | 2.0 | 2.0 | 2.0 |
| Propylene Glycol. | 2.0 | 2.0 | |
| 2.0 | | | |
| Brightener | 0.5 | 0.5 | 0.5 |
| TSPP | 37.0 | 37.0 | 37.0 |
| Imvite IGS | 3.0 | 3.0 | 3.0 |
| KTS (50% Active) | — | 4.0 | 1.0 |
| **Stability Data** | **Depth of Liquid Surface Layer** | | |
| 1 Day 70° F. | 0.0 cm | 0.0 cm | 0.1 cm |
| 1 Week 70° F. | 0.2 cm | 0.0 cm | 0.3 cm |
| 2 Weeks 70° F. | 0.5 cm | 0.0 cm | 0.5 cm |
| 4 Weeks 70° F. | 0.8 cm | 0.0 cm | 0.7 cm |
| 8 Weeks 70° F. | 1.1 cm | 0.0 cm | 0.7 cm |
| 12 Weeks 70° F. | 1.6 cm | 0.0 cm | 1.0 cm |
| 1 Day 120° F. | 0.3 cm | 0.0 cm | 0.1 cm |
| 1 Week 120° F. | 0.5 cm | 0.0 cm | 0.5 cm |
| 2 Weeks 120° F. | 0.9 cm | 0.0 cm | 1.0 cm |
| 4 Weeks 120° F. | 1.0 cm | 0.0 cm | 1.2 cm |
| 8 Weeks 120° F. | 1.2 cm | 0.0 cm | 1.2 cm |
| 12 Weeks 120° F. | 1.4 cm | 0.0 cm | 1.4 cm |

Table VIII below demonstrates the effect of adding various amounts of propylene glycol (about 0% to 7%) to the mulls of the present invention. These amounts of propylene glycol did not substantially affect the stability of these suspensions.

TABLE VIII

| Ingredient | Parts A | B | C | D | E |
|---|---|---|---|---|---|
| Neodol 23-5 | 49.5 | 49.5 | 49.5 | 49.5 | 49.5 |
| MAXAZYME | 2.0 | 2.0 | 2.0 | 2.0 | 2.0 |
| TSPP | 37.0 | 37.0 | 37.0 | 37.0 | 37.0 |
| Brightener | 0.5 | 0.5 | 0.5 | 0.5 | 0.5 |
| LAS | 5.0 | 5.0 | 5.0 | 5.0 | 5.0 |
| Propylene Glycol | — | 1.0 | 3.0 | 5.0 | 7.0 |
| Imvite IGS | 3.0 | 3.0 | 3.0 | 3.0 | 3.0 |
| **Stability Data** | **Depth of Liquid Surface Layer** | | | | |
| 1 Day 70° F. | 0.0 cm | 0.0 cm | 0.0 cm | 0.0 cm | 0.1 cm |
| 1 Week 70° F. | 0.1 cm | 0.2 cm | 0.2 cm | 0.1 cm | 0.2 cm |
| 2 Weeks 70° F. | 0.4 cm | 0.4 cm | 0.3 cm | 0.5 cm | 0.4 cm |
| 4 Weeks 70° F. | 0.7 cm | 0.8 cm | 0.6 cm | 0.7 cm | 0.7 cm |
| 8 Weeks 70° F. | 1.0 cm | 0.9 cm | 0.8 cm | 0.9 cm | 0.8 cm |
| 12 Weeks 70° F. | 1.1 cm | 1.1 cm | 0.9 cm | 0.9 cm | 1.0 cm |
| 1 Day 120° F. | 0.1 cm | 0.5 cm | 0.5 cm | 0.4 cm | 0.5 cm |
| 1 Week 120° F. | 0.6 cm | 0.8 cm | 0.8 cm | 0.7 cm | 0.8 cm |
| 2 Weeks 120° F. | 1.1 cm | 1.0 cm | 1.2 cm | 1.1 cm | 1.2 cm |
| 4 Weeks 120° F. | 1.4 cm | 1.5 cm | 1.5 cm | 1.5 cm | 1.6 cm |
| 8 Weeks 120° F. | 1.8 cm | 1.9 cm | 1.9 cm | 1.8 cm | 1.9 cm |
| 12 Weeks 120° F. | 1.8 cm | 1.9 cm | 1.9 cm | 1.8 cm | 1.8 cm |

Table IX below shows the effects of various amounts of water (0% to 3%) on the stability of the compositions.

TABLE IX

| Ingredient | Parts A | B | C | D |
|---|---|---|---|---|
| Neodol 23-5 | 49.5 | 49.5 | 49.5 | 49.5 |
| MAXAZYME | 2.0 | 2.0 | 2.0 | 2.0 |
| TSPP | 37.0 | 37.0 | 37.0 | 37.0 |
| Brightener | 0.5 | 0.5 | 0.5 | 0.5 |
| LAS | 5.0 | 5.0 | 5.0 | 5.0 |
| Imvite IGS | 3.0 | 3.0 | 3.0 | 3.0 |
| Water* | — | 1.0 | 2.0 | 3.0 |
| **Stability Data** | **Depth of Liquid Surface Layer** | | | |
| 1 Day 70° F. | 0.0 cm | 0.1 cm | 0.1 cm | 0.1 cm |
| 1 Week 70° F. | 0.3 cm | 0.3 cm | 0.2 cm | 0.3 cm |
| 2 Weeks 70° F. | 0.6 cm | 0.5 cm | 0.6 cm | 0.7 cm |
| 4 Weeks 70° F. | 1.0 cm | 1.0 cm | 1.0 cm | 1.0 cm |
| 8 Weeks 70° F. | 1.3 cm | 1.2 cm | 1.2 cm | 1.2 cm |
| 12 Weeks 70° F. | 1.6 cm | 1.2 cm | 1.4 cm | 1.3 cm |
| 1 Day 120° F. | 0.3 cm | 0.4 cm | 0.4 cm | 0.3 cm |
| 1 Week 120° F. | 0.7 cm | 0.7 cm | 0.7 cm | 0.8 cm |
| 2 Weeks 120° F. | 1.1 cm | 1.2 cm | 1.1 cm | 1.2 cm |
| 4 Weeks 120° F. | 1.6 cm | 1.5 cm | 1.4 cm | 1.5 cm |
| 8 Weeks 120° F. | 2.0 cm | 1.5 cm | 1.5 cm | 1.5 cm |
| 12 Weeks 120° F. | 2.0 cm | 1.5 cm | 1.5 cm | 1.5 cm |

*Cincinnati municipal water

Table X below shows the effects of various combinations of the components of the present invention on the physical stability of the compositions.

TABLE X

| Ingredient | Parts A | B | C | D | E | F | G | H | I | J |
|---|---|---|---|---|---|---|---|---|---|---|
| Neodol 23-5 | 49.5 | 49.5 | 49.5 | 49.5 | 49.5 | 49.5 | 49.5 | 49.5 | 49.5 | 49.5 |
| TSPP | 37.0 | 37.0 | 37.0 | 37.0 | 37.0 | 37.0 | 37.0 | 37.0 | 37.0 | 37.0 |
| Imvite IGS | — | 3.0 | — | — | 3.0 | 3.0 | 3.0 | 3.0 | — | — |
| LAS | — | — | 5.0 | — | 5.0 | — | 5.0 | 5.0 | 5.0 | 5.0 |
| Propylene Glycol | — | — | — | — | — | — | 2.0 | — | 2.0 | — |
| Water | — | — | — | 1.0 | — | 1.0 | — | 1.0 | — | 1.0 |
| **Stability Data** | **Depth of Liquid Surface Layer** | | | | | | | | | |
| 1 Day 70° F. | 1.8 cm | 0.0 cm | 0.1 cm | 1.2 cm | 0.0 cm | 0.0 cm | 0.0 cm | 0.0 cm | 0.3 cm | 0.3 cm |
| 1 Week 70° F. | 2.3 cm | 0.1 cm | 0.6 cm | 1.5 cm | 0.0 cm | 0.0 cm | 0.0 cm | 0.0 cm | 1.4 cm | 1.2 cm |
| 2 Weeks 70° F. | 2.4 cm | 0.4 cm | 1.4 cm | 1.6 cm | 0.2 cm | 0.1 cm | 0.1 cm | 0.0 cm | 1.9 cm | 1.5 cm |
| 4 Weeks 70° F. | 2.5 cm | 0.6 cm | 1.9 cm | 1.7 cm | 0.4 cm | 0.2 cm | 0.4 cm | 0.2 cm | 2.0 cm | 1.8 cm |
| 8 Weeks 70° F. | 2.6 cm | 0.9 cm | 2.1 cm | 1.8 cm | 0.5 cm | 0.3 cm | 0.5 cm | 0.3 cm | 2.0 cm | 1.8 cm |
| 12 Weeks 70° F. | 2.8 cm | 1.3 cm | 2.6 cm | 1.9 cm | 1.1 cm | 0.4 cm | 1.1 cm | 0.3 cm | 1.9 cm | 2.2 cm |
| 1 Day 120° F. | 2.0 cm | 0.1 cm | 0.4 cm | 1.5 cm | 0.1 cm | 0.0 cm | 0.0 cm | 0.0 cm | 1.1 cm | 1.5 cm |
| 1 Week 120° F. | 2.5 cm | 0.5 cm | 2.0 cm | 1.9 cm | 0.4 cm | 0.0 cm | 0.5 cm | 0.2 cm | 2.0 cm | 2.0 cm |
| 2 Weeks 120° F. | 2.8 cm | 0.8 cm | 2.1 cm | 1.9 cm | 0.8 cm | 0.2 cm | 0.6 cm | 0.5 cm | 2.1 cm | 2.4 cm |
| 4 Weeks 120° F. | 3.0 cm | 1.0 cm | 2.5 cm | 2.0 cm | 1.2 cm | 0.4 cm | 1.0 cm | 0.5 cm | 2.4 cm | 2.6 cm |
| 8 Weeks 120° F. | 3.0 cm | 1.0 cm | 2.8 cm | 2.0 cm | 1.4 cm | 0.4 cm | 1.1 cm | 0.6 cm | 2.5 cm | 2.5 cm |
| 12 Weeks 120° F. | 3.2 cm | 1.2 cm | 3.0 cm | 2.0 cm | 1.8 cm | 0.3 cm | 1.3 cm | 0.7 cm | 2.5 cm | 2.8 cm |

Study of Table X will reveal that every tested composition containing a chain structure type clay (Compositions B, E, F, G and H) provided greater stability than did any tested composition which contained no clay (Compositions A, C, D, I and J). Table X also shows that LAS and water each have value as auxiliary suspension aids when added to compositions already containing a chain structure type clay.

We claim:

1. A liquid mull having a liquid phase and a dispersed solid phase, comprising:

A. 30% to 95% of a liquid nonionic surfactant;

B. 1% to 65% of a dispersed particulate material which is insoluble in said liquid phase; and C. 1% to 15% of a chain structure type clay.

2. The mull of claim 1, further comprising 0% to 25% of an auxiliary suspension aid selected from anionic surfactants, cationic surfactants, zwitterionic surfactants, and hydrotropic materials; and 0% to 10% water.

3. The mull of claim 2, further characterized as being substantially anhydrous.

4. The mull of claim 3, wherein said dispersed particulate material comprises a laundry enzyme, present in sufficient quantity to provide an enzyme activity of from 0.01 to 0.15 Anson units per gram of said mull.

5. The mull of claim 4, wherein said mull comprises 1% to 50% of a bleach in dispersed particulate form.

6. The mull of claim 2, further characterized as comprising:

A. 40% to 75% of said liquid nonionic surfactant;

B. 15% to 55% of said dispersed particulate material;

C. 2% to 12% of an impalpable chain structure type clay selected from the sepiolite, attapulgite and palygorskite clays;

D. 0% to 15% of said auxiliary suspension aid; and

E. 0% to 10% water.

7. The mull of claim 6, wherein said liquid nonionic surfactant is selected from the polyethylene oxide condensates of aliphatic alcohols; the polyethylene oxide condensates of alkyl phenols; the polyethylene oxide condensates of a hydrophobic base, in turn comprising the condensate of propylene oxide with propylene glycol; the polyethylene oxide condensates of the product of reaction of propylene oxide and ethylene diamine; the amine type of nonionic surface active agents; the semi-polar types of nonionic surface active agents; and mixtures thereof.

8. The mull of claim 7, wherein said nonionic surfactant has an HLB of from about 7 to about 16, and is selected from polyethylene oxide condensates of aliphatic alcohols, polyethylene oxide condensates of alkyl phenols, and mixtures thereof.

9. The mull of claim 8, wherein said polyethylene oxide condensates of aliphatic alcohols are hydrocarbon alcohols having an average chain length of 9 to 15 carbon atoms, condensed with an ethylene oxide chain having an average chain length of 3 to 15 ethylene oxide moieties; and wherein said polyethylene oxide condensates of alkyl phenols have an alkyl chain length of from 8 to 9 carbon atoms, and have an average ethylene oxide chain length of from 3 to 15 ethylene oxide moieties.

10. The mull of claim 6, wherein said dispersed particulate material is a detergency builder.

11. The mull of claim 10, wherein said detergency builder is a condensed alkali metal polyphosphate selected from sodium tripolyphosphate, potassium tripolyphosphate, tetrasodium pyrophosphate, tetrapotassium pyrophosphate, and mixtures thereof.

12. The mull of claim 6, wherein said suspension aid is selected from the alkali metal soaps, alkali metal salts of alkyl benzene sulfonates with alkyl chain lengths of 1 to 22 carbon atoms, and di- (long chain) cationic surfactants.

13. The mull of claim 12, wherein said suspension aid is selected from alkali metal toluene sulfonates, linear straight chain alkyl benzene sulfonates with an average chain length of about 11.8 carbon atoms, and ditallow dimethyl ammonium chloride.

14. The mull of claim 6, further characterized as being substantially anhydrous.

15. The mull of claim 14, further comprising 5% to 35% of a peroxygen bleach which is insoluble in said liquid phase.

16. The mull of claim 15, wherein said peroxygen bleach is selected from alpha-omega diperoxyacids having chain lengths of from 6 to 16 carbon atoms; alkali metal perborates, persulfates, persilicates, perphosphates, and percarbonates; benzoyl peroxide; alkyl mono- and diperoxy succinic acids having alkyl chain lengths of from 8 to 18 carbon atoms and mixtures thereof.

17. The mull of claim 16, wherein said peroxygen bleach is selected from alpha-omega diperoxyacids having from 6 to 16 carbon atoms, and mixtures thereof.

18. The mull of claim 14, further comprising a sufficient quantity of a protease laundry enzyme, insoluble in said liquid phase, to provide said mull with an enzyme activity of 0.01 to 0.10 Anson units per gram of said mull.

19. The mull of claim 18, wherein said enzyme is selected from MAXITASE®, MAXAZYME®, AMYLASE®, and mixtures thereof.

20. The mull of claim 6, further characterized as comprising:

A. 40% to 60% of a linear primary hydrocarbon alcohol having 11 to 15 carbon atoms, condensed with an average of from about 3 to about 7 moles of ethylene oxide;

B. 20% to 45% of a particulate condensed alkali metal polyphosphate selected from sodium tripolyphosphate, potassium tripolyphosphate, tetrasodium pyrophosphate, tetrapotassium pyrophosphate, and mixtures thereof;

C. 4% to 10% of an impalpable attapulgite or sepiolite clay;

D. 0% to 7% of a dispersion aid selected from alkali metal toluene sulfonates, linear straight chain alkyl benzene sulfonates with an average alkyl chain length of about 11.8 carbon atoms, and ditallow dimethyl ammonium chloride; and E. 0% to 5% water.

21. The mull of claim 20, further characterized as being substantially anhydrous.

22. The mull of claim 21, further comprising 5% to 35% of an alpha-omega diperoxyacid having a carbon chain length of 6 to 16 carbon atoms.

23. The mull of claim 22, wherein said diperoxyacid is selected from diperoxydodecanedioic acid and a mixture of diperoxytridecanedioic acid and diperoxyadipic acid in a ratio of from about 1:3 to about 3:1.

24. The mull of claim 21, further comprising a sufficient quantity of a laundry enzyme selected from MAXITASE®, MAXAZYME® and AMYLASE®, to provide for said mull an activity of from 0.01 to 0.1 Anson units per gram of said mull.

25. The mull of claim 24, wherein said laundry enzyme is MAXAZYME®.

26. The mull of claim 20, further characterized as a substantially anhydrous mull comprising:

A. about 54% of a linear primary hydrocarbon alcohol having 12 to 13 carbon atoms, condensed with an average of five moles of ethylene oxide;

B. about 35% tetrasodium pyrophosphate;

C. about 8% of an impalpable sepiolite clay; and

D. about 2% MAXAZYME®.

* * * * *

UNITED STATES PATENT AND TRADEMARK OFFICE

CERTIFICATE OF CORRECTION

PATENT NO. : 4,264,466

DATED : April 28, 1981

INVENTOR(S) : Karen L. Carleton and John P. Rowland

It is certified that error appears in the above-identified patent and that said Letters Patent are hereby corrected as shown below:

Col. 39, line 6, insert -- 2.0 -- under the C column, Table VII.

Col. 39, line 7, delete "2.0" under the Ingredient column, Table VII.

Signed and Sealed this

*Twentieth* Day of *October 1981*

[SEAL]

*Attest:*

GERALD J. MOSSINGHOFF

*Attesting Officer*

*Commissioner of Patents and Trademarks*